US005480628A

United States Patent [19]

Ishikawa et al.

[11] Patent Number: 5,480,628

[45] Date of Patent: Jan. 2, 1996

[54] COLOR DEVELOPER AND PROCESSING METHOD USING THE SAME

[75] Inventors: Takatoshi Ishikawa; Masakazu Yoneyama, both of Minami, Japan

[73] Assignee: Fuji Photo Film Co., Ltd., Kanagawa, Japan

[21] Appl. No.: 287,596

[22] Filed: Aug. 8, 1994

Related U.S. Application Data

[63] Continuation of Ser. No. 70,870, Jun. 3, 1993, abandoned.

[30] Foreign Application Priority Data

Jun. 3, 1992 [JP] Japan ..... 4-166759

[51] Int. Cl.[6] ..... G03C 7/413

[52] U.S. Cl. ..... 430/493; 430/464; 430/486

[58] Field of Search ..... 430/434, 444, 430/464, 486, 493

[56] References Cited

U.S. PATENT DOCUMENTS

| | | | |
|---|---|---|---|
| 4,774,169 | 9/1988 | Kuse et al. | 430/467 |
| 4,892,804 | 1/1990 | Vincent et al. | 430/380 |
| 4,966,834 | 10/1990 | Ishikawa et al. | 430/393 |
| 5,004,676 | 3/1991 | Meckl et al. | 430/398 |
| 5,063,131 | 11/1991 | Abe et al. | 430/429 |
| 5,187,051 | 2/1993 | Ishikawa | 430/448 |
| 5,206,120 | 4/1993 | Hayashi | 430/377 |

FOREIGN PATENT DOCUMENTS

| | | |
|---|---|---|
| 0436947 | 7/1991 | European Pat. Off. . |
| 2205377 | 9/1972 | Germany . |
| 2215382 | 10/1972 | Germany . |
| 62-234161 | 10/1987 | Japan . |
| 3240054 | 10/1991 | Japan . |
| 1387713 | 3/1973 | United Kingdom . |
| 1382901 | 2/1975 | United Kingdom . |

OTHER PUBLICATIONS

Research Disclosure, No. 16986, May 1978.

Derwent Publications Ltd., AN 74–89351V & JP–A–49 062 127, Jun. 17, 1974.

*Primary Examiner*—Hoa V. Le

*Attorney, Agent, or Firm*—Birch, Stewart, Kolasch & Birch

[57] ABSTRACT

There is disclosed a color developer and a method for processing a silver halide color photographic material with said color developer. The color developer comprises a water-soluble silicone compound, preferably at least one water-soluble silicone compound represented by the following formula (I):

wherein $R_1$, $R_2$, $R_3$, and $R_4$, which may be the same or different, each represent a substituent or a linking group; at least one of $R_1$, $R_2$, $R_3$, and $R_4$ represents a water-soluble group; A represents a bivalent group; and n is an integer of 0 to 10.

16 Claims, No Drawings

COLOR DEVELOPER AND PROCESSING METHOD USING THE SAME

This application is a continuation, of application Ser. No. 08/070,870 filed on Jun. 3, 1993, now abandoned.

FIELD OF THE INVENTION

The present invention relates to a novel color developer and a method for processing a silver halide color photographic material using said color developer. More particularly, the present invention relates to a color developer and a processing method wherein the fluctuation of photographic properties (particularly the maximum optical density) at the time of continuous processing or resulting from deterioration of the color developer with the lapse of time is made small, and at the same time smudge occurred in the processing tank or on the photographic material is lessened and the developing agent is prevented from deposition from the developer at low temperature.

BACKGROUND OF THE INVENTION

In the method for processing silver halide color photographic materials, for the purposes of shortening the processing time and lowering pollution, techniques that use a high-silver-chloride emulsion are disclosed in WO 87/04534 (corresponding to U.S. Pat. No. 4,892,804) and U.S. Pat. No. 5,004,676. If a high-silver-chloride emulsion is used, indeed, the processing time can be shortened, but on the contrary the fluctuation of the maximum density becomes disadvantageously large with the change in the pH of the color developer or the change of the developing agent concentration.

Conventionally, the occurrence of tar resulting from oxidation and deterioration of a developer at the time of continuous processing is a problem, and a sulfite or a bisulfite is used as a preservative of developing solution. But, when the amount of sulfite or bisulfite is decreased as much as possible because it affects the color density, tar, which is oxidized products of color developing agents, is apt to be produced, causing undesired stain on the photographic material and the processor. Further, a deposit attributable to the developing agent at the interface between the air and the processing solution in the processing tank is apt to be produced, causing smudge or stain, flaws, and the like. Therefore, solutions for these problems are expected.

As is described in WO 87/04534, from the environmental viewpoint, it is preferable to eliminate benzyl alcohol, which is conventionally used as a color formation accelerator of color development. But if benzyl alcohol is eliminated, a new problem arises that when the color developer is aged at low temperature in winter, the color-developing agent deposits, which is expected to be solved.

On the other hand, a technique wherein various surface-active agents are added to a color developer is described in JP-A ("JP-A" means unexamined published Japanese patent application) No. 234161/1987 or U.S. Pat. No. 4,774,169. However, the effect of the surface-active agents used in JP-A No. 234161/1987 is not satisfactory for the purpose of the present invention, whereas JP-A No. 42155/1987 does not refer to the matter of the present invention at all and the effect of the surface-active agents as used therein is not satisfactory. *Research Disclosure No.* 16986 discloses a technique wherein the washing out of a sensitizing dye is accelerated by adding a nonionic surface-active agent, thereby reducing the residual color. But it does not refer to the matter of the present invention at all and the effect of that technique is unsatisfactory in the system of the present invention.

EP No. 436947A and JP-A No. 240054/1991 disclose techniques wherein an anionic surface-active agent and a nonionic surface-active agent are used in a color developer containing few sulfite ions, to reduce stain due to processing. But the techniques have the defects that the effect is small and deposition of the developing agent at low temperature is increased, and therefore the techniques are not satisfactory.

SUMMARY OF THE INVENTION

Therefore, an object of the present invention is to provide a color developer and a method for processing a silver halide color photographic material that can make small the fluctuation of photographic properties (particularly the maximum optical density) at the time of continuous processing and to prevent undesirable smudge (particularly, growth of a deposit at the interface between the air and the liquid) in a processing tank.

Another object of the present invention is to provide a color developer that can prevent a color-developing agent, for example, in a replenisher tank, from crystallizing at low temperature.

A further object of the present invention is to provide a method for processing a silver halide color photographic material that can prevent a color-developing agent, for example, in a replenisher tank, from crystallizing at low temperature.

Other and further objects, features and advantages of the invention will appear more evident from the following description.

DETAILED DESCRIPTION OF THE INVENTION

It has been found that the objects of the present invention can be achieved by carrying out the following techniques:

(1) A color developer comprising a water-soluble silicone compound.

(2) A method comprising the step of processing an exposed color photographic material with a color developer comprising a water-soluble silicone compound.

(3) A method for processing a silver halide color photographic material, which comprises processing said silver halide color photographic material with a color developer containing at least one water-soluble silicone compound represented by the following formula (I): formula (I)

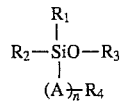

wherein $R_1$, $R_2$, $R_3$, and $R_4$, which may be the same or different, each represent a substituent or a linking group; at least one of $R_1$, $R_2$, $R_3$, and $R_4$ represents a water-soluble group; A represents a bivalent group; and n is an integer of 0 to 10.

(4) The method for processing a silver halide color photographic material as stated under (2), wherein said color developer is substantially free from sulfite ions.

(5) The method for processing a silver halide color photographic material as stated under (2), wherein the silver halide color photographic material comprises at least one layer of a high-silver-chloride emulsion having a chlorine ion content of 90 mol % or more.

(6) The method for processing a silver halide color photographic material as stated under (2), wherein the processing is carried out with the temperature of the color developer being 37° C. or higher.

It is completely unexpected that, in the present invention, use of the above silicone compound not only can suppress the fluctuation of photographic properties but also can suppress the occurrence and growth of a deposit in a processing tank, and can prevent a developing agent from crystallization at low temperature. Herein the term "deposit" does not mean one that has deposited or crystallized due to the solubility in the solution; rather it means one that has been occurred near the part where the color developer is in contact both with the air and with members of the tank (e.g., the wall surface and members of a synthetic resin such as a floating lid), and such a deposit is completely different from one in the solution. This phenomena frequently occurs particularly at constricted sections, such as the corners of the tank and a floating lid, and it is particularly noticeable in the case of a color developer substantially free from sulfite or bisulfite. At a processing temperature of 37° C. or higher, its occurrence is excessive and the effect of the present invention is exhibited remarkably. With regard to fluctuation of photographic properties, also the effect can be obtained remarkably at 37° C. or higher.

The expression "crystallization at low temperature" refers to a phenomena that the color-developing agent crystallizes on a tank bottom when the tank solution or the replenishing solution of a color developer is cooled to 10° C. or below, particularly to 5° C. or below, in particular in winter, which crystallization will cause clogging of a pipeline system and various pumps, causing problems. This phenomena tends to occur particularly with a color developer free from benzyl alcohol.

Further, since generally silicone compounds do not dissolve in water, conventionally it cannot be considered that a silicone compound is used in a processing solution, such as a color developer, which directly affects photographic properties, but, unexpectedly, various problems have been solved by rendering a silicone compound soluble in water.

Now the present invention will be described in detail.

The water-soluble silicone compound to be used in the present invention is not a common hydrophobic silicone compound but a silicone compound that can dissolve to some extent in an aqueous alkali solution. Specifically, the water-soluble silicone compound is a compound that can be dissolved in an amount of 5 mg/l or more, preferably 10 mg/l or more, and particularly preferably 10 mg to 100 g/l, in water at a temperature of 10 ° C. and at a pH of 10.

Further, preferably the compound of the present invention has a surface-active property that can lower the surface tension of water. For example, in the present invention, it is effective to use one that can lower the surface tension of water by 5 dyne/cm or more, preferably 10 dyne/cm or more, when measured by the usual method, for example, a capillary method, a droplet-weight method, and a ring method.

The compound of the present invention is preferably a silicone compound having a water-soluble group or a silicone compound containing siloxane units having a water-soluble group.

In formula (I), when $R_1$, $R_2$, $R_3$, and $R_4$ represent substituents, which may be the same or different, each represent a hydrogen atom, a halogen atom, an alkyl group, an aryl group, or an alkoxy group. The alkyl group has preferably about 1 to 10 carbon atoms, particularly preferably 1 to 4 carbon atoms. Specifically, a methyl group or an ethyl group is particularly preferable. As the aryl group, for example, a phenyl group or a naphthalene group can be mentioned. As the alkoxy group, for example, a methoxy group or an ethoxy group can be mentioned. Among others, a lower alkoxy group is preferable. These alkyl group, aryl group, and alkoxy group may be substituted if necessary. Preferably substituents include a halogen atom (e.g., fluorine, chlorine, bromine, and iodine), a methyl group, an ethyl group, an alkoxy group (e.g., methoxy and ethoxy), an acyl group (e.g., acetyl and benzoyl), an acyloxy group (e.g., acetoxy and benzoyloxy), an amino group (e.g., amino, dimethylamino, and diethylamino), a hydroxyl group, a nitro group, a sulfonic group, and a carboxylic group.

As the halogen atom, a chlorine atom, a fluorine atom, and an iodine atom can be mentioned.

When at least one of $R_1$, $R_2$, $R_3$, and $R_4$ is a linking group, preferably it has a structure having siloxane units given below, preferably 2 or more, more preferably 5 to 60, in number.

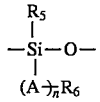

wherein $R_5$ and $R_6$ have the same meanings as $R_1$, $R_2$, R3, and $R_4$ in formula (I), provided that at least one of $R_5$ and $R_6$ represents a water-soluble group as defined for $R_1$, $R_2$, $R_3$, and $R_4$, and A and n have the same meanings as A and n in formula (I).

As the water-soluble group, known ones can be used with preference given to $-(CH_2CH_2O)_a-H$, $-(CH(CH_3)CH_2O)_b-H$, $-(CH_2CH_2CH_2O)_c-H$, $-COOM$, $-SO_3M$, $-OSO_3M$, $-PO_3M_2$, and $-OH$, wherein a, b, and c are each an integer of 3 to 100 (preferably 5 to 50), M represents a hydrogen atom, an alkali metal salt, or an ammonium salt.

In formula, $R_5$ and $R_6$ have the same meanings as those of $R_1$, $R_2$, $R_3$, and $R_4$.

A represents a bivalent group. Known bivalent linking groups can be used. Specifically, A represents, for example, a methylene group, an ethylene group, a propylene group, or an oxo group.

n is an integer of 0 to 10.

When n is 2 or more, the A groups may be the same or different.

Preferably the siloxan unit described above is incorporated with a unit not having a water-soluble group.

Specific examples of the water-soluble silicone compound are shown below, but the present invention is not restricted to them.

I-1
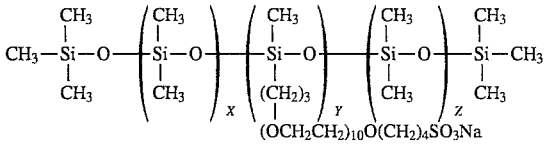
X + Z = 40
Y = 10
I-2
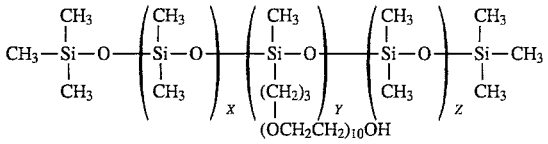
X + Z = 3
Y = 2
I-3
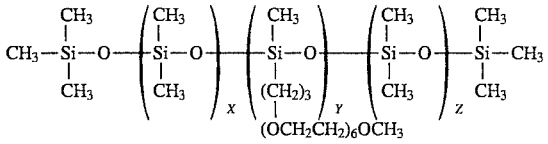
X + Z = 0
Y = 1
I-4
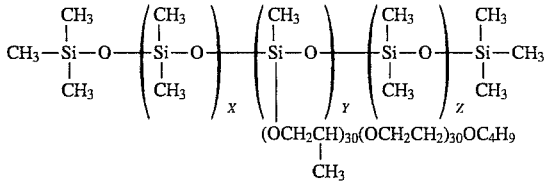
X + Z = 10
Y = 5
I-5
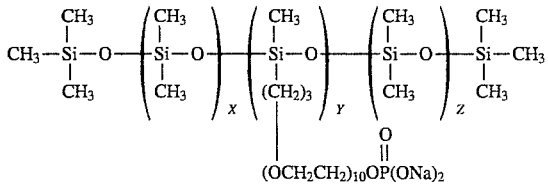
X + Z = 25
Y = 5
I-6
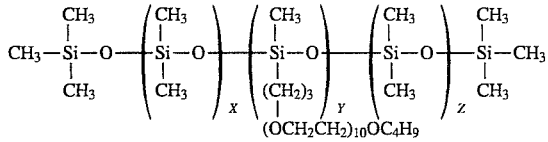
X + Z = 25
Y = 5
I-7
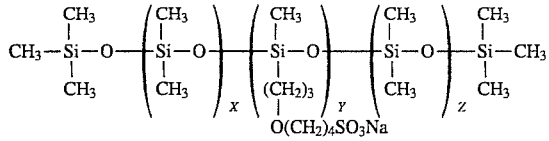
X + Z = 27
Y = 6
I-8
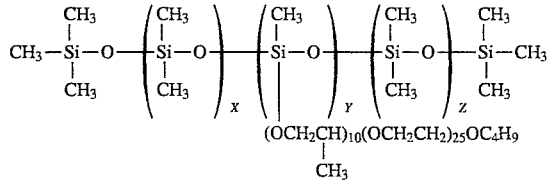
X + Z = 30
Y = 5
I-9
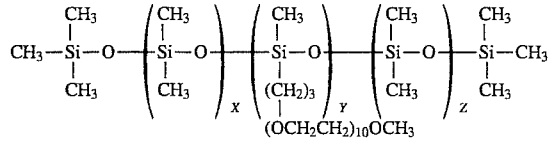
X + Z = 10
Y = 5

-continued
I-10
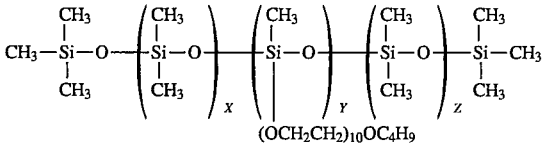
X + Z = 60
Y = 10
I-11
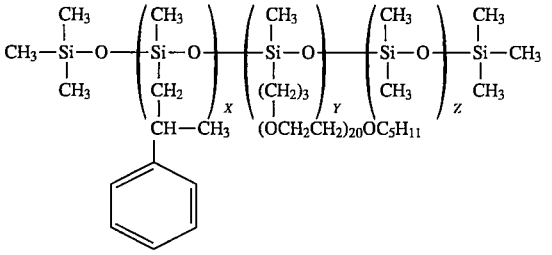
X + Z = 30
Y = 10
I-12
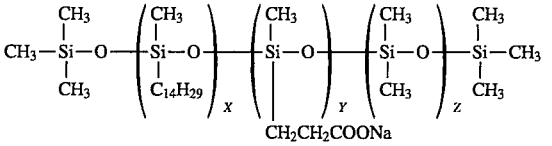
X + Z = 10
Y = 5
I-13
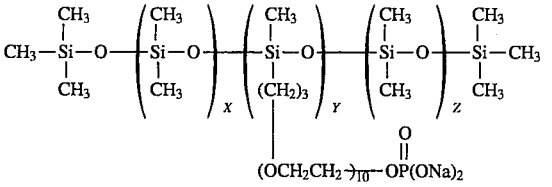
X + Z = 10
Y = 5
I-14
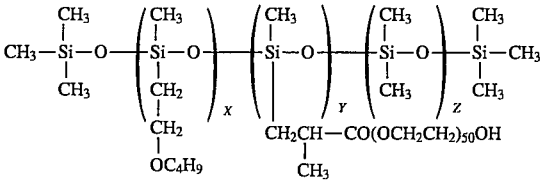
X + Z = 40
Y = 10
I-15
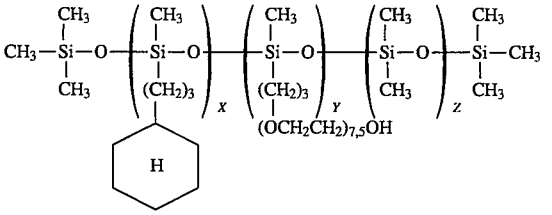
X + Z = 10
Y = 5
I-16
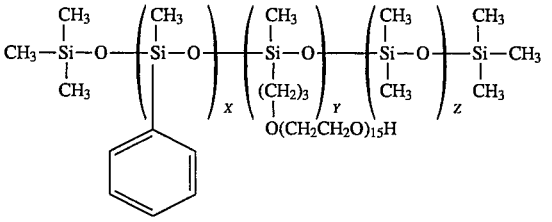
X + Z = 20
Y = 5
I-17
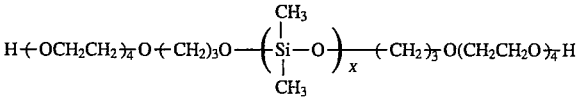
X = 10

-continued

I-18

$$NaO_3S(CH_2)_4(OCH_2CH_2)_4O(CH_2)_3O-\left(\begin{matrix}CH_3\\|\\Si-O\\|\\CH_3\end{matrix}\right)_x-(CH_2)_3O(CH_2CH_2O)_4(CH_2)_4SO_3Na$$

X = 20

I-19

$$(NaO)_2\overset{\overset{O}{\|}}{P}(OCH_2CH_2)_4O(CH_2)_3O-\left(\begin{matrix}CH_3\\|\\Si-O\\|\\CH_3\end{matrix}\right)_x-(CH_2)_3O(CH_2CH_2O)_4\overset{\overset{O}{\|}}{P}(ONa)_2$$

X = 15

I-20

$$H(OCH_2CH_2)_7O(CH_2)_3O-\left(\begin{matrix}CH_3\\|\\Si-O\\|\\CH_3\end{matrix}\right)_x-(CH_2)_3O(CH_2CH_2O)_7H$$

X = 10

I-21

$$NaO_3S(CH_2)_4O(CH_2)_3O-\left(\begin{matrix}CH_3\\|\\Si-O\\|\\CH_3\end{matrix}\right)-(CH_2)_3O(CH_2)_4SO_3Na$$

I-22

$$(CH_3)_3SiO-CH_2(CH_2CH_2O)_{10}H$$

I-23

$$(C_2H_5)_3SiO-\begin{matrix}CH_2OH\\|\\SiO\\|\\CH_2OH\end{matrix}-\begin{matrix}CH_2OH\\|\\SiO\\|\\CH_2OH\end{matrix}-CH_2CH_2SO_3H$$

I-24

$$H_3SiO(\begin{matrix}CH_3\\|\\SiO\\|\\CH_3\end{matrix})_{10}-CH_2PO_3H_2$$

I-25

$$(CH_3O)_3SiO(\begin{matrix}CH_3\\|\\SiO\\|\\CH_3\end{matrix})_{20}(CH_2CH_2O)_{10}-H$$

I-26

$$(CH_3)_3SiO(\begin{matrix}CH_3\\|\\SiO\\|\\CH_3\end{matrix})_{20}(\begin{matrix}CH_3\\|\\SiO\\|\\CH_2\\|\\O(CH_2CH_2O)_{10}H\end{matrix})_{10}-Si(CH_3)_3$$

I-27

$$(CH_3)_3SiO(\begin{matrix}CH_3\\|\\SiO\\|\\CH_3\end{matrix})_{24}(\begin{matrix}CH_3\\|\\SiO\\|\\(CH_2)_3\\|\\O(CH_2CH_2)_{10}-H\end{matrix})_4Si(CH_3)_3$$

I-28

$$CH_3-\begin{matrix}CH_3\\|\\SiO\\|\\CH_3\end{matrix}-\begin{matrix}CH_3\\|\\Si\\|\\CH_3\end{matrix}-CH_2SO_3H$$

I-29

$$(CH_3)_3SiO(\begin{matrix}CH_3\\|\\SiO\\|\\CH_3\end{matrix})_{10}(\begin{matrix}CH_3\\|\\SiO\\|\\(CH_2)_3\\|\\O(CH_2CH_2O)_{10}-PO_3H_2\end{matrix})_5Si(CH_3)_3$$

I-30

$$(CH_3)_3SiO(\begin{matrix}CH_3\\|\\SiO\\|\\CH_3\end{matrix})_{30}(\begin{matrix}CH_3\\|\\SiO\\|\\(CH_2)_3\\|\\O(CH_2CH_2CH_2O)_8PO_3H_2\end{matrix})_5Si(CH_3)_3$$

I-31

$$(CF_3)_3SiO(\begin{matrix}CH_2OH\\|\\SiO\\|\\CH_2OH\end{matrix})_{10}-(\begin{matrix}CH_3\\|\\SiO\\|\\CH_3\end{matrix})_{10}-CH_2SO_3H$$

-continued

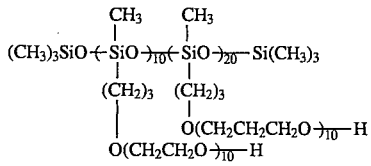

I-32

These compounds can be commercially available, but can be synthesized by the method described in *The Chemistry of Organic Silicon Compounds* 1989, JOHN WILEY & SONS.

The amount of these compounds to be added is generally 0.01 to 10 g, preferably 0.03 to 3 g, per liter of color developer. If necessary, compounds more than 2 may be used in combination.

In the present invention, the photographic material is subjected to a color developing process, a desilvering process, and an water-washing process (or a stabilizing treatment).

The color developer to be used in the present invention contains known aromatic primary amine color-developing agent. Preferred examples are p-phenylene-diamine derivatives, and as representative examples thereof can be mentioned N,N-diethyl-p-phenylenediamine, 2-amino-5-diethylaminotoluene, 2-amino-5-(N-ethyl-N-laurylamino)toluene, 4-[N-ethyl-N-(β-hydroxyethyl)amino]-aniline, 2-methyl-4-[N-ethyl-N-(β-hydroxyethyl)amino]-aniline, 4-amino-3-methyl-N-ethyl-N-[β-(methanesulfonamido)ethyl]-aniline, N-(2-amino-5-diethylaminophenylethyl-)methanesulfonamide, N,N-dimethyl-p-phenylenediamine, 4-amino-3-methyl-N-ethyl-N-methoxyethylaniline, 4-amino-3-methyl-N-ethyl-N-β-ethoxyethylaniline, and 4-amino-3-methyl-N-ethyl-N-β-butoxyethylaniline. Among them, 4-amino-3-methyl-N-ethyl-N-[β-(methanesulfonamido)ethyl]-aniline is particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of color developer.

The compound of the present invention is useful when its concentration in a replenishing solution is preferably 8 g/l or more, more preferably 9 g/l or more. The effect of the present invention can be attained by using 4-amino-3-methyl-N-ethyl-N-[β-(methanesulfonamido)ethyl]-aniline.

In practicing the present invention, remarkable effects can be attained in the case of using a color developer substantially free from benzyl alcohol. Herein the term "substantially free from" means that the concentration of benzyl alcohol is preferably 2.0 ml/l or below, more preferably 0.5 ml/l or below, and most preferably benzyl alcohol is not contained at all.

It is more preferable that the color developer for use in this invention is substantially free from sulfite ions (herein "substantially free from" means that the concentration of sulfite ions is $3.0\times10^{-3}$ mol/l or below), in order to suppress the variation of photographic properties due to the continuous processing and to attain the effects of the invention more remarkably. More preferably the concentration of sulfite ions is $1.0\times10^{-3}$ mol/l or below, and most preferably sulfite ion is not contained at all.

Preferably, the color developer to be used in the present invention is substantially free from sulfite ions, and more preferably, in addition thereto it is substantially free from hydroxylamine (herein "substantially free from hydroxylamine" means that preferably the concentration of hydroxylamine is $5.0\times10^{-3}$ mol/l or below), in order to suppress the variation of photographic properties due to the changing of concentration of hydroxylamine. Most preferably hydroxylamine is not contained at all.

It is more preferable that the color developer to be used in the present invention contains an organic preservative instead of above-described hydroxylamine or sulfite ions.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary ammonium salts, nitroxyradicals, alcohols, oximes, diamide compounds, and condensed cyclic amines are effective organic preservatives. These are disclosed, for example, JP-B ("JP-B" means examined Japanese patent publication) No. 30496/1973, JP-A Nos. 143020/1977, 4235/1988, 30845/1988, 21647/1988, 44655/1988, 53551/1988, 43140/1988, 56654/1988, 58346/1988, 43138/1988, 146041/1988, 44657/1988, and 44656/1988, U.S. Pat. Nos. 3,615,503 and 2,494,903, and JP-A Nos. 97953/1989, 186939/1989, 186940/1989, 187557/1989, and 306422/1990. As the other preservative, various metals described in JP-A Nos. 44148/1982 and 53749/1982, salicylic acids described in JP-A No. 180588/1984, amines described in JP-A Nos. 239447/1988, 128340/1988, 186939//1989, and 187557/1989,alkanolamines described in JP-A No. 3532/1979, polyethyleneimines described in JP-A No. 94349/1981, aromatic polyhydroxyl compounds described in U.S. Pat. No. 3,746,544 maybe included, if needed. It is particularly preferable the addition of alkanolamines, such as triethanolamine, dialkylhydroxylamines, such as N,N-diethylhydroxylamine and N,N-di(sulfoethyl)hydroxylamine, hydrazine derivatives (excluding hydrazine), such as N,N-bis(carboxymethyl)-hydrazine, or aromatic polyhydroxyl compounds, such as sodium catechol-3,5-disulfonate.

In particular, the use of alkanolamines in combination with dialkylhydroxylamine and/or hydrazine derivatives is more preferable in view of stability improvement of the color developer resulting its stability improvement during the continuous processing.

In the present invention, the color developer preferably contains chloride ions in an amount of $3.0\times10^{-2}$ to $1.5\times10^{-1}$ mol/l, more preferably $3.5\times10^{-2}$ to $1\times10^{-1}$ mol/l. When the concentration of chloride ions exceeds $1.5\times10^{-1}$ mol/l, such a defect as to retard the developing occurs, which is not preferable to attain the effect of the present invention of rapid processing and high maximum density. A concentration less than $3.0\times10^{-2}$ mol/l is not preferably in view of preventing fogging.

In the present invention, the color developer preferably contains bromide ions in an amount of $3\times10^{-5}$ to $1\times10^{-3}$ mol/l, more preferably $5.0\times10^{-5}$ to $5\times10^{-4}$ mol/l. When the concentration of bromide ions exceeds $1\times10^{-3}$ mol/l, developing is retarded, resulting maximum density and sensitivity being lowered, and when the concentration is less than $3.0\times10^{-5}$ mol/l, fogging cannot be prevented sufficiently.

Herein, chloride ions and bromide ions may be added directly to the color developer, or they may be allowed to dissolve out from the photographic material in the color developer at the development processing.

If chloride ions are added directly to the color developer, as the chloride ion-supplying material can be mentioned sodium chloride, potassium chloride, ammonium chloride, lithium chloride, magnesium chloride, and calcium chloride. Further, they may be supplied from a fluorescent brightening agent that is added to the color developer.

As the bromide ion-supplying material can be mentioned sodium bromide, potassium bromide, ammonium bromide, lithium bromide, calcium bromide, and magnesium bromide.

When chloride ions and bromide ions are allowed to dissolve out from the photographic material in the color developer, both the chloride ions and bromide ions may be supplied from the emulsion or a source other than the emulsion.

Preferably the pH of the color developer to be used in the present invention is in the range of 9 to 12, more preferably 9 to 11.0, and other known compounds that are components of a conventional developing solution can be contained in the color developing solution.

In order to keep the above pH, it is preferable to use various buffers. As buffers, use can be made, for example, of carbonates, phosphates, borates, tetraborates, hydroxylbenzoates, glycyl salts, N,N-dimathylglycinates, leucinates, norleucinates, guanine salts, 3,4-dihydroxy-phenylalanine salts, alanine salts, aminobutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH 9.0 or higher, they do not adversely affect the photographic function (for example, to cause fogging), and they are inexpensive.

As specified samples of buffer, there are included sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l or more, and particularly preferably 0.1 to 0.4 mol/l.

In addition to the color developer can be added various chelating agents to prevent calcium or magnesium from precipitating or to improve the stability of the color developer. Specific examples are shown below: nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediamine-tetraacetic acid, 1,2-diaminopropanetetraacetic acid, glycol ether diaminetetraacetic acid, ethylenediamine-ortho-hydroxyphenylacetic acid, 2-phosphonobutane-1,2,4-tricarboxylic acid, 1-hydroxyethylidene-1,1-diphosphonic acid, N,N'-bis(2-hydroxybenzyl-)ethylene-diamine-N,N'-diacetic acid, hydroxyethyliminodiacetic acid. If necessary, two or more of these chelating agents may be used together.

With respect to the amount of these chelating agents to be added, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1963, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles. With respect to benzyl alcohol, it is same as the above-described.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

It is preferable that the color developer that is adaptable in the present invention contains a fluorescent brightening agent. As the fluorescent brightening agent, 4,4'-diamino-2,2'-disulfostilbene compounds are preferable, which will be added in an amount of 0 to 5 g/l, preferably 0.1 to 4 g/l.

If required, various surface-active agents, such as alkylsulfonic acids, arylsulfonic acids, aliphatic carboxylic acids, aromatic carboxylic acids, and polyalkyleneimines may be added.

With respect to the color developer of the present invention, for details other than the above described those of a usual color developer can be adapted.

The processing temperature of the color developer adaptable to the present invention is 20° to 50° C., preferably 30° to 40° C., and most preferably 37° to 40° C. The processing time is 20 sec to 5 min, and preferably 25 sec to 1 min. Although it is preferable that the replenishing amount is as small as possible, it is suitable that the replenishing amount is 20 to 600 ml, preferably 30 to 200 ml, more preferably 40 to 100 ml, per $m^2$ of the photographic material.

The photographic material is generally subjected to a desilvering process after color development. The desilvering process can be carried out by a bleaching process and a fixing process, separately, or carried out at the same time (bleach-fixing process). Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process may be carried out after the bleach-fixing process.

As the bleaching agent to be used in a bleaching solution and a bleach-fixing solution, use can be made of, for example, iron salts, compounds of polyvalent metals, such as iron (III), cobalt (III), chromium (VI), and copper (II), peracids, quinones, and nitro compounds. As typical bleaching agents, use can be made of iron chlorides, ferricyanides, dichromates, organic complex salts of iron (III) (e.g., complex salts of aminopolycarboxylic acid, such as ethylenediaminetetra-acetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid), persulfates, bromates, permanganates, and nitrobenzenes. Of these, aminopolycarboxylic acid complex salts of iron (III), including ethylenediaminetetraacetic acid iron (III) complex salts and 1,3-diaminopropanetetraacetic acid iron (III) complex salts are preferable in view of the rapid processing and the prevention of environmental pollution. Further, aminopolycarboxylic acid iron (III) complex salts are particularly useful in a bleaching solution as well as a bleach-fix solution. The bleaching solution or the bleach-fix solution using these aminopolycarboxylic acid iron (III) complex salts is generally used in pH 3 to 8.

Known additives, for example, a rehalogenating agent such as ammonium bromide and ammonium chloride, a pH buffer such as ammonium nitrare, and a metal-corrosion-preventing agent such as ammonium sulfate can be added in the bleaching solution or the bleach-fix solution.

In addition to the above-described compounds, an organic acid is preferably contained in the bleaching solution and the bleach-fix solution. Particularly preferable organic acids include compounds having an acid dissociation constant (pKa) of 2 to 5.5, and specifically acetic acid and propionic acid are preferable.

Although as the fixing agents to be used in the fixing solution and bleach-fix solution use can be made of thiosulfates, thiocyanates, thioether compounds, thioureas, and a large amount of iodide salts, the use of thiosulfate is general, particularly ammonium thiosulfate can be used most widely. Further, combination use of thiosulfate with thiocyanate, thioether compound, or thiourea is also preferable.

As a preservative for the fixing solution and the bleach-fixing solution, sulfites, bisulfites, carbonyl-bisulfic acid adduct or sulfinic acid compounds described in European Patent No. 294769A are preferable. Further, it is preferable to add various aminopolycarboxylic acids or organic phosphonic acids (e.g., 1-hydroxyethylidene-1,1-diphosphonic acid and N,N,N',N'-ethylenediaminetetraohosphonic acid) in the fixing solution and the bleach-fix solution for the purpose to stabilize the solution.

Further, in the fixing solution and the bleach-fixing solution, various fluorescent brightening agents, antifoamers, surface-active agents, poly(vinyl pyrrolidone), and methanol can be included.

In the bleaching solution, the bleach-fix solution, and/or bath preceding them, various compounds may be used as a bleach-accelerating agent, according to a need. As specific examples of useful bleach-accelerating agents, use can be made of, for example, compounds having a mercapto group or a disulfido group, described in U.S. Pat. No. 3,893,858, West German Patent No. 1,290,812, and JP-A No. 95630/1978, and *Research Disclosure* No. 17129 (July 1978), thiazolizine compounds described in JP-A No. 140129/1975, thiourea compounds described in U.S. Pat. No. 3,706,561, iodide salts described in JP-A No. 16235/1983, polyoxyethylene compounds described in West German Patent No. 2,748,430, polyamine compounds described in JP-B No. 8836/70, and bromide ions. Among them, compounds having a mercapto group or disulfide group are preferable in view of large accelerating effect, in particular, compounds described in U.S. Pat. No. 3,893,858, West German Patent No. 1,290,812, and JP-A No. 95630/1978 are preferable. Further, the compound described in U.S. Pat. No. 4,552,834 is also preferable. These bleach-accelerating agents may be added in the photographic material. These bleach-accelerating agents are particularly effective for bleach-fixing a color photographic material for photography.

The shorter the total time of the desilvering step is, the more preferable it is within the range wherein silver retention does not occur. Preferably it is 10 sec to 3 min, more preferably 20 sec to 2 min. The processing temperature is 25° to 50° C., preferably 35° to 45° C. In the preferable temperature range, the desilvering speed is improved and occurrence of stain 10 after the processing is effectively prevented.

In the desilvering step, preferably the stirring is enhanced as much as possible. Specific techniques for enhancing the stirring that can be mentioned include a method described in JP-A No. 183460/1987 or No. 15 183461/1987, wherein a jet of a processing liquid is caused to impinge upon the emulsion surface of a photographic material; a method described in JP-A No. 183461/1987, wherein a rotating means is used for increasing the stirring effect; a method wherein a photographic material is moved with a wiper blade provided in a liquid in contact with the emulsion surface, to make the liquid near the emulsion surface turbulent, thereby improving the stirring effect; and a method wherein the circulated flow rate of all the processing liquid is increased. Such a means of improving stirring is effective for any of a bleaching solution, a bleach-fix solution, and a fixing solution. It is considered that the improvement of stirring quickens the supply of a bleaching agent and a fixing agent into emulsion layers,and as a result the speed of desilvering is increased. Further when a bleach accelerator is used, the above means of improving stirring is more effective, increases the accelerating effect noticeably; and it can cancel the fixing-hindrance effect of the bleach accelerator.

The automatic processor to be used for the photographic material according to the present invention is preferably provided with a photographic material transporting means described in JP-A Nos. 191257/1985, 191258/1985, and 191259/1985. As is described in JP-A No. 191257/1985, such a transporting means can reduce considerably the carry-in of the processing liquid from a preceding bath to the succeeding bath, and it is high in the effect of preventing the performance of the processing liquid from being deteriorated. Such an effect is particularly efficacious in shortening the processing time in each step and in reducing the replenishing amount of the processing liquid.

Generally, the color photographic material of the present invention is subjected to a washing step after the desilvering process. Instead of the washing step, a stabilizing step can be carried out. In such a stabilizing process, any of known methods described in JP-A Nos. 8543/1982, 14834/1983, and 220345/1985 can be used. A washing step/stabilizing step, wherein a stabilizing bath containing a dye stabilizer and a surface-active agent that is typically used for processing a photographing color photographic material is used as a final bath, can be carried out.

The washing solution and the stabilizing solution can contain a water softener, such as an inorganic phosphoric acid, polyaminocarbonic acid and an organic aminophosphonic acid; a metal salt such as an Mg salt, an Al salt, and a Bi salt; a surface-active agent; and a hardening agent.

The amount of washing water in the washing step can be set over a wide range, depending on the characteristics of the photographic material (e.g., the characteristics of the material used, such as couplers), the usage of the photographic material, the washing water temperature, the number of the washing water tanks (stages), the type of replenishing, such as the countercurrent type or of the down flow type, and other various conditions. Further, to solve such problems as the propagation of bacteria when the amount of washing water is decreased greatly at a countercurrent flow system and the adhering of suspended matter to the photographic material, the method for reducing calcium ions and magnesium ions, described in JP-A No. 288838, can be used quite effectively. Also, isothiazolone compounds and cyabendazoles described in JP-A No. 8542/1982, chlorine-type disinfectant such as chlorinated sodium isocyanurate, benzotriazoles, and other bactericides described by Hiroshi Horiguchi in *Bokin Bobai-zai no Kagaku,* (1986) published by Sankyo-Shuppan, *Biseibutsu no Mekkin, Sakkin, Bobai-qijutsu* (1982) edited by Eiseigijutsu-kai, published by Kogyo-Gijutsu-kai, and in *Bokin Bobaizai Jiten* (1986) edited by Nihon Bokin Bobai-gakkai, can be used.

The pH of the washing water used in the washing step is 4 to 9, preferably 5 to 8. The washing water temperature and the washing time to be set may vary depending, for example, on the characteristics and the application of the photographic material, and they are generally selected in the range of 15° to 45° C. for 20 sec to 10 min, and preferably in the range of 25° to 40° C. for 30 sec to 5 min.

As dye-stabilizing agents to be able to use in a stabilizing solution, aldehydes such as formalin and gultalaldehyde, N-methylol compounds, hexamethylenetetramine, and aldehyde-sulfic acid adduct can be mentioned. Further, the stabilizing solution can contain pH controlling buffer, such as boric acid and sodium hydride, 1-hydroxyethylidene-1, 1-diphosphonic acid, chelating agent, such as ethylenediaminetetraacettic acid, sulfulation-preventer, such as alkanolamine, fluorescent brightening agent, and antimold agent.

The over-flowed solution due to the above-mentioned replenishing of Washing solution and/or stabilizing solution may be reused in other steps, such as a desilvering step.

In the processing using an automatic processor, it is preferable to correct the concentration of processing solution by adding water when concentration due to evaporation occurs.

The silver halide color photographic material of the present invention may contain therein a color-developing agent for the purpose of simplifying and quickening the process. To contain such a color-developing agent, it is preferable to use a precursor for color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in Research Disclosure No. 13924, and metal salt complexes described in U.S. Pat. No. 3,719,492, and urethane-type compounds described in JP-A No. 135628/1978 can be mentioned.

For the purpose of accelerating the color development, the silver halide color photographic material of the present invention may contain, if necessary, various 1-phenyl-3-pyrazolidones. Typical compounds are described in JP-A Nos. 64339/1981, 144547/1982, and 115438/1983.

The present invention may be adapted in any of photographic materials. In the present invention, as silver halide emulsions and other materials (e.g., additives), photographic constituting layers (e.g., arrangement of layers), processing processes and additives for processing there can be preferably used those described in the following patent, particularly European Patent EP 0,355,660A2 (JP-A No. 107011/1989).

| Element constituting photographic material | JP-A No. 215272/1987 | JP-A No. 33144/1990 | EP 0,355,660A2 |
|---|---|---|---|
| Silver halide emulsion | p. 10 upper right column 6 to p. 12 lower left column line 5, and p. 12 lower right column line 4 from the bottom to p. 13 upper left column line 17 | line p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow | p. 91 upper right column line 4 to p. 121 upper left column line 6 | p. 3 upper right column line 14 to p. 18 upper left column last line and | p. 4 lines 15 to 27, p. 5 line 30 to p. 28 last line, |

-continued

| Element constituting photographic material | JP-A No. 215272/1987 | JP-A No. 33144/1990 | EP 0,355,660A2 |
|---|---|---|---|
| coupler) | | p. 30 upper right column line 6 to p. 35 lower right column line 11 | p. 45 lines 29 to 31 and p. 47 line 23 to p. 63 line 50 |
| Color Formation-strengthen agent | p. 121 upper left column line 7 to p. 125 upper right column line 1 | — | — |
| Ultraviolet absorbing agent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development inhibitor | p. 155 lower right column lines 3 to 9 | — | — |
| Support | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p. 66 lines 18 to 22 |
| Color-mix inhibitor | p. 185 upper left column line to p. 18 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 17 |
| Surface-active agent | p. 201 lower left column line 1 to p. 210 upper right column last line | p.18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column 6 to p. 225 upper left column last line | line p. 38 upper right column lines 8 to 18 | p. 66 lines 23 to 28 |
| Thickening agent | p. 225 upper riqht column line 1 to p. 227 upper right column line 2 | — | — |
| Antistatic agent | p. 227 upper right column line to p. 227 upper | — | — |

-continued

| Element constituting photographic material | JP-A No. 215272/1987 | JP-A No. 33144/1990 | EP 0,355,660A2 |
|---|---|---|---|
| | left column line 1 | | |
| Polymer latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note: In the cited part of JP-A No. 215272/1987, amendment filed on March 16, 1987 is included. Further, among the above-mentioned couplers, it is preferred to use so called short wavelength-type low coupler, described in JP-A Nos. 231451/1988, 123047/1988, 241547/1988, 173499/1989, 213648/1989, and 250944/1989, as a yellow coupler.

Further, as cyan couplers, diphenylimidazole cyan couplers described in JP-A No. 33144/1990, as well as 3-hydroxypyridine cyan couplers described in European Patent EP 0,333,185A2 (in particular one obtained by causing Coupler (42), which is a four-equivalent coupler, to have a chlorine coupling-off group, thereby rendering it two-equivalent, and Coupler (6) and (9), which are listed as specific examples, are preferable) and cyclic active methylene cyan couplers described in JP-A No. 32260/1989 (in particular, specifically listed Coupler Examples 3, 8, and 32 are preferable) are preferably used.

Although, as a silver halide for use in the present invention, for example, silver chloride, silver bromide, silver chlorobromide, silver iodochlorobromide, and silveriodobromide can be used, particularly for the purpose of the present invention, a silver chlorobromide emulsion or a silver chloride emulsion substantially free from silver iodide and having a silver chloride content of 90 mol % or more, preferably 95 mol % or more, particulary preferably 98 mol % or more, is used preferably.

In the photographic material according to the present invention, in order to improve, for example, sharpness of the image, preferably a dye capable of being decolored by processing (in particular an oxonol dye), as described in European Patent EP 0,337,490A2, pages 27 to 76, is added to a hydrophilic colloid layer, so that the optical reflection density of the photographic material at 680 nm may be 0.70 or over, 12 wt % or more (preferably 14 wt % or more) of titanium dioxide the surface of which has been treated with a secondary to quarterary alcohol (e.g., trimethylolethane) or the like is contained in a water-resistant resin layer of the support.

In the photographic material according to the present invention, preferably together with the coupler a color-image preservability-improving compound, as described in European Patent EP 0,277,589A2, is used. Particularly a combination with a pyrazoloazole coupler is preferable.

That is, when a compound (F), which will chemically combine with the aromatic amine developing agent remaining after the color development processing to form a chemically inactive and substantially colorless compound, and/or a compound (G), which will chemically combine with the oxidized product of the aromatic amine color developing agent remaining after the color development processing to form a chemically inactive and substantially colorless compound, are used simultaneously or singly, it is preferable because the occurrence of stain and other side effects, for example, due to the production of a color-formed dye by reaction of the coupler with the color-developing agent or its oxidized product remaining in the film during the storage after the processing, can be prevented.

To the photographic material according to the present invention, a mildew-proofing agent described, for example, in JP-A No. 271247/1988, is preferably added in order to prevent the growth of a variety of mildews and fungi that will propagate in the hydrophilic colloid layer and deteriorate the image thereon.

As a support to be used for the photographic material according to the present invention, a white polyester support for display may be used, or a support wherein a layer containing white pigment is provided on the side that will have a silver halide layer. Further, in order to improve sharpness, preferably an anti-halation layer is applied on the side of the support where the silver halide emulsion layer is applied or the undersurface of the support. In particular, preferably the transmission density of the support is set in the range of 0.35 to 0.8, so that the display can be appreciated through either reflected light or transmitted light.

The photographic material according to the present invention may be exposed to visible light or infrared light. The method of exposure may be low-intensity exposure or high-intensity short-time exposure, and particularly in the later case, the laser scan exposure system, wherein the exposure time per picture element is less than $10^{-4}$ sec is preferable.

When exposure is carried out, the band stop filter, described in U.S. Pat. No. 4,880,726, is preferably used. Thereby light color-mixing is eliminated and the color reproduction is remarkably improved.

According to the present invention, the fluctuation of photographic properties during a continuous processing can be made small, and smudges in a processing tank during a continuous processing and the crystallization of color developing agent in a replenishing tank at low temperature can be prevented.

The present invention will be described in detail in accordance with examples, but the invention is not limited to these examples.

EXAMPLE 1

After the surface of a paper support, whose both surfaces were laminated with polyethylene, was subjected to corona discharge treatment, a gelatin undercoat layer containing sodium dodecylbenzenesulfonate was provided thereon, and various photographic constitutional layers were applied, to prepare a multi-layer color photographic printing paper A having the below-given layer constitution. The coating solution were prepared as follows:

Preparation of the Fifth Layer Coating Solution 50.0 Milliliters of ethyl acetate and 14.0 g of Solvent (Solv-6) were added to 32.0 g of Cyan Coupler (ExC), 3.0 g of Image-dye Stabilizer (Cpd-2), 2.0 g of Image-dye Stabilizer (Cpd-4), 18.0 g of Image-dye stabilizer (Cpd-6), 40.0 g of Image-dye stabilizer (Cpd-7), and 5.0 g of Image-dye Stabilizer (Cpd-8), to dissolve them, and the solution was added into 500 ml of 20% aqueous gelatin solution containing 8 ml of 10% sodium dodecylbenzenesulfonate, and emulsified and dispersed by a supersonic homogenizer, to prepare an emulsified dispersion. Separately, a silver chlorobromide emulsion (comprising cubic silver halide grains made up of a mixture of a large size emulsion having an average grain size of 0.58 μm and a small size emulsion having an average grain size of 0.45 μm in a molar ratio of 1:4 in terms of silver, wherein the deviation coefficients of the grain size distributions are 0.09 and 0.11, respectively; each of the emulsions has 0.6 mol % of AgBr being localized on the surface of the grains; and the remaining part of grain is made of AgCl) was prepared. Red-sensitive sensitizing dye E, shown below, was added in this emulsion in an amount of $0.9\times10^{-4}$ mol to the large size emulsion and $1.1\times10^{-4}$ mol to the small size emulsion, per mol of silver, respectively. The chemical ripening of this emulsion was carried out by adding a sulfur sensitizing agent and a gold sensitizing agent. The above-described emulsified dispersion and this red-sensitive silver chlorobromide emulsion were mixed together and dissolved to give the composition shown below, thereby preparing the fifth layer coating solution.

Coating solutions for the first to fourth, and sixth and seventh layers were prepared in the same manner as the fifth layer coating solution. As the gelatin hardener of each layer, 1-oxy-3,5-dichloro-s-triazine sodium salt was used. Cpd-10 and Cpd-11, shown below, were added to each layer so that the total amounts thereof might be 25.0 mg/m$^2$ and 50.0 mg/m$^2$, respectively.

In the silver chlorobromide emulsions of photosensitive emulsion layers, the following spectral sensitizing dyes were used.

Blue-sensitive emulsion layer:

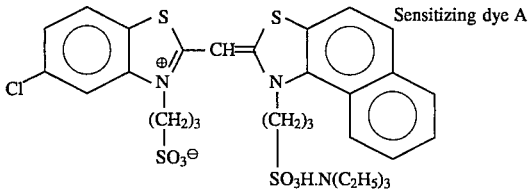

and

-continued

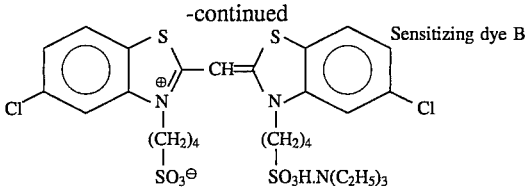

(each $2.0\times10^{-4}$ mol to the large size emulsion and $2.5\times10^{-4}$ mol to the small size emulsion, per mol of silver halide. )

Green-sensitive emulsion layer:

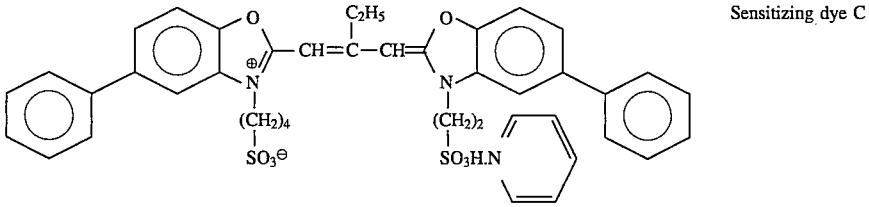

($4.0\times10^{-4}$ mol to the large size emulsion and $5.6\times10^{-4}$ mol to the small size emulsion, per mol of silver halide)

and

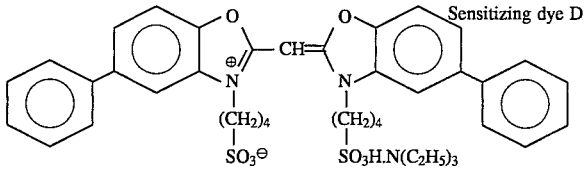

($7.0\times10^{-5}$ mol to the large size emulsion and $1.0\times10^{-5}$ mol to the small size emulsion, per mol of silver halide)

Red-sensitive emulsion layer:

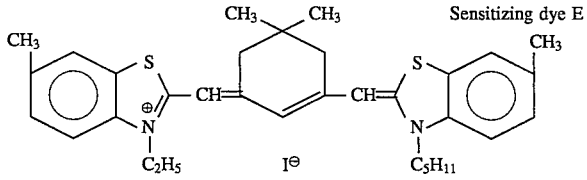

($0.9\times10^{-4}$ mol to the large size emulsion and $1.1\times10^{-4}$ mol to the small size emulsion, per mol of silver halide )

To the red-sensitive emulsion layer, the following compound was added in an amount of $2.6\times10^{-3}$ mol per mol of silver halide:

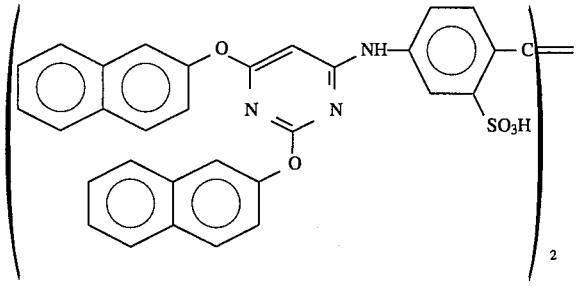

Further, respectively to the blue-sensitive emulsion layer, the green-sensitive emulsion layer, and the red-sensitive emulsion layer, was added 1-(5-methylureidophenyl)-5-mercaptotetrazole in respective amounts of $8.5\times10^{-5}$ mol, $7.7\times10^{-4}$ mol, and $2.5\times10^{-4}$ mol, per mol of the silver halide.

Further, respectively to the blue-sensitive emulsion layer and the green-sensitive emulsion layer, was added 4-hydroxy-6-methyl-1,3,3a,7-tetrazaindene in respective amounts of $1\times10^{-4}$ mol and $2\times10^{-4}$ mol, per mol of the silver halide.

Further, to prevent irradiation, the following dye (the coating amount is indicated in parentheses) was added to the emulsion layers.

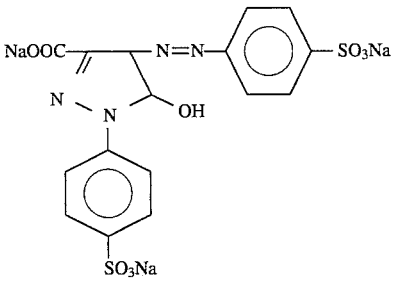

(10 mg/m²)

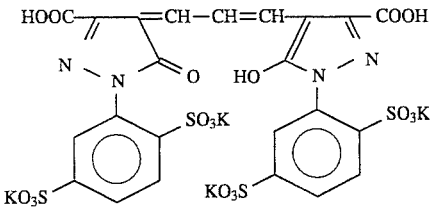

(10 mg/m²)

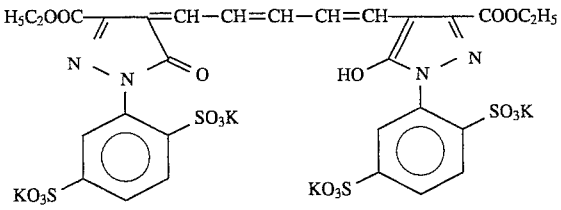

(40 mg/m²)

and

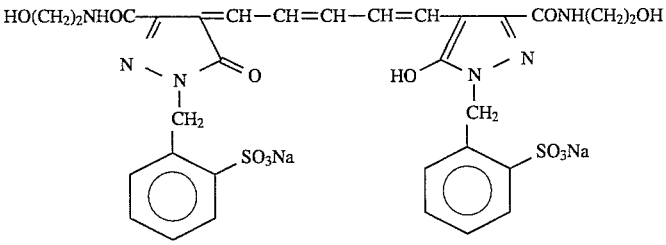

(20 mg/m²)

(Layer Composition)

The layer compositions of the layers are shown below. The numerals indicate coating amounts (g/m²). The coating amount of each of the silver halide emulsions is in terms of silver.

Support

Paper laminated on both sides with polyethylene (a white pigment, $TiO_2$, and a bluish dye, ultra-marine, were included in the first layer side of the polyethylene-laminated film)

| First Layer (Blue-sensitive emulsion layer) | |
|---|---|
| Silver chlorobromide emulsion (comprising cubic silver halide grains made up of a mixture of a large size emulsion having an average grain size of 0.88 μm and a small size emulsion having an average grain size of 0.70 μm in a molar ratio of 3:7 in terms of silver, wherein the deviation coefficients of the grain size distributions are | 0.30 |

-continued

| | |
|---|---|
| 0.08 and 0.10 respectively; each of the emulsions has 0.3 mol % of silver bromide being localized on the surface of the grains; and the remaining part of grain is made of silver chloride) | |
| Gelatin | 1.86 |
| Yellow coupler (ExY) | 0.82 |
| Image-dye stabilizer (Cpd-1) | 0.19 |
| Solvent (Solv-3) | 0.18 |
| Solvent (Solv-7) | 0.18 |
| Image-dye stabilizer (Cpd-7) | 0.06 |

-continued

| | |
|---|---|
| Second Layer (Color-mix preventing layer) | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer) | |
| Silver chlorobromide emulsion (comprising cubic silver halide grains made up of a mixture of a large size emulsion having an average grain size of 0.55 μm and a small size emulsion having an average grain size of 0.39 μm in a molar ratio of 1:3 in terms of silver, wherein the deviation coefficients of the grain size distributions are 0.10 and 0.08 respectively; each of the emulsions has 0.8 mol % of silver bromide being localized on the surface of the grains; and the remaining part of grain is made of silver chloride) | 0.12 |
| Gelatin | 1.24 |

-continued

| | |
|---|---|
| Cyan coupler (ExC) | 0.32 |
| Image-dye stabilizer (Cpd-2) | 0.03 |
| Image-dye stabilizer (Cpd-4) | 0.02 |
| Image-dye stabilizer (Cpd-6) | 0.18 |
| Image-dye stabilizer (Cpd-7) | 0.40 |
| Image-dye stabilizer (Cpd-8) | 0.05 |
| Solvent (Solv-6) | 0.14 |
| Sixth layer (Ultraviolet-absorbing layer) | |
| Gelatin | 0.53 |
| Ultraviolet-absorbing agent (UV-1) | 0.16 |
| Color-mix inhibitor (Cpd-5) | 0.02 |
| Solvent (Solv-5) | 0.08 |
| Seventh layer (Protective layer) | |
| Gelatin | 1.33 |
| Acryl-modified copolymer of polyvinyl alcohol (modification degree: 17%) | 0.17 |
| Liquid paraffin | 0.33 |

Compounds used are as follows:

(ExY) Yellow coupler

Mixture (1:1 in molar ratio) of (a) and (b)

(a)

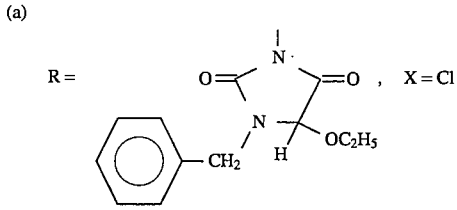

(b)

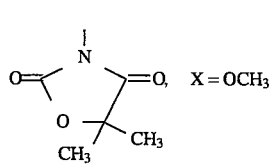

of

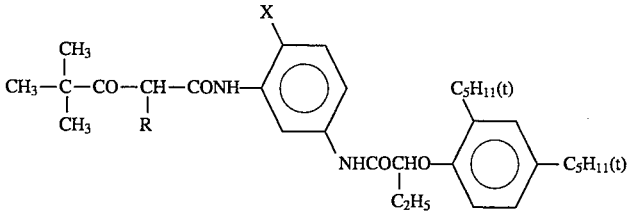

(ExM) Magenta coupler

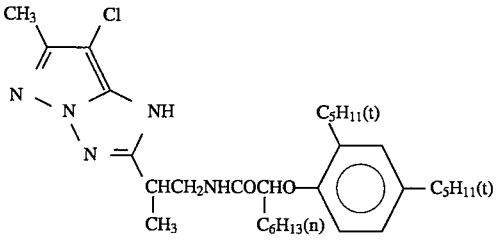

(ExC) Cyan coupler

Mixture (1:1 in molar ratio) of

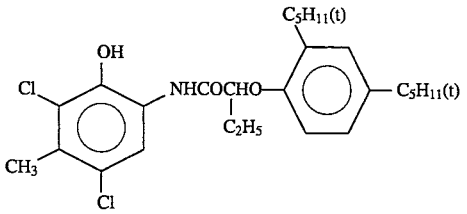

-continued

| | |
|---|---|
| Magenta coupler (ExM) | 0.23 |
| Image-dye stabilizer (Cpd-2) | 0.03 |
| Image-dye stabilizer (Cpd-3) | 0.16 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet-absorbing layer) | |
| Gelatin | 1.58 |
| Ultraviolet-absorbing agent (UV-1) | 0.47 |
| Color-mix inhibitor (Cpd-5) | 0.05 |
| Solvent (Solv-5) | 0.24 |
| Fifth Layer (Red-sensitive emulsion layer) | |
| Silver chlorobromide emulsion (comprising cubic silver halide grains made up of a mixture of a large size emulsion having an average grain size of 0.58 μm and a small size emulsion having an average grain size of 0.45 μm in a molar ratio of 1:4 in terms of silver, wherein the deviation coefficients of the grain size distributions are 0.09 and 0.11 respectively; each of the emulsions has 0.6 mol % of silver bromide being localized on the surface of the grains; and the remaining part of grain is made of silver chloride) | 0.23 |
| Gelatin | 1.34 |

-continued
and
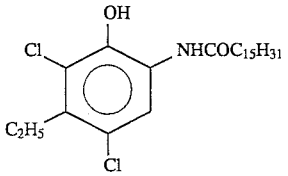
(Cpd-1) Image-dye stabilizer
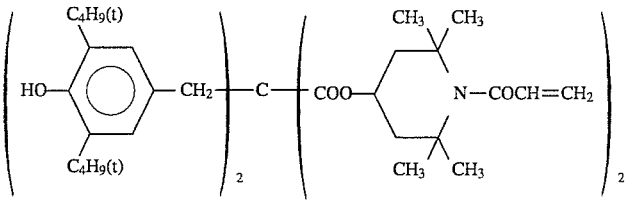
(Cpd-2) Image-dye stabilizer
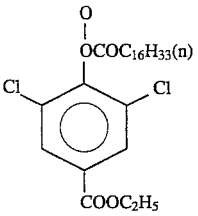
(Cpd-3) Image-dye stabilizer
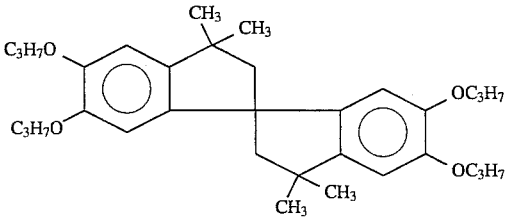
(Cpd-4) Image-dye stabilizer
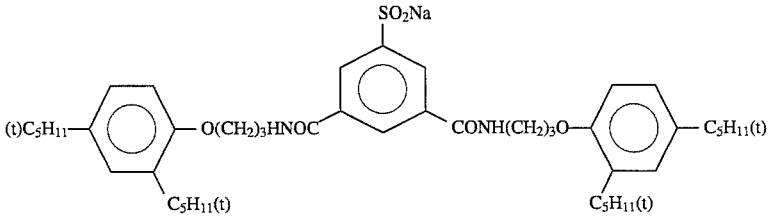
(Cpd-5) Image-dye stabilizer
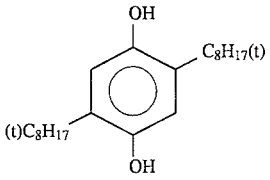
(Cpd-6) Image-dye stabilizer
Mixture ((i):(ii):(iii)=2:4:4 in weight ratio) of
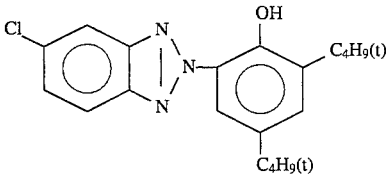
(i)
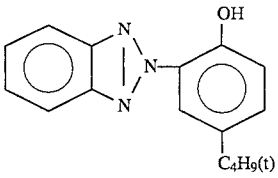
(ii)
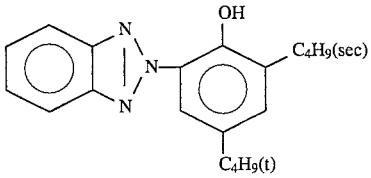
(iii)

(Cpd-7) Image-dye stabilizer

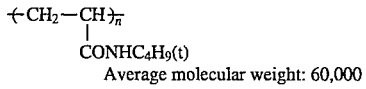

Average molecular weight: 60,000

(Cpd-8) Image-dye stabilizer

Mixture (1:1 in weight ratio) of

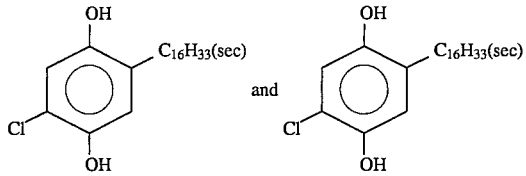

(Cpd-9) Image-dye stabilizer (Cpd-10) Antiseptic

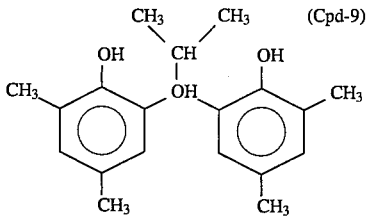

(Cpd-9) Image-dye stabilizer

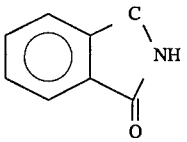

(Cpd-10) Antiseptic (Cpd-11) Antiseptic

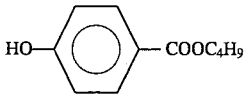

(UV-1) Ultraviolet-absorbing agent

Mixture ((iv):(v):(vi)=4:2:4 in weight ratio) of

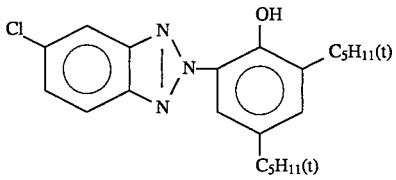

(iv)

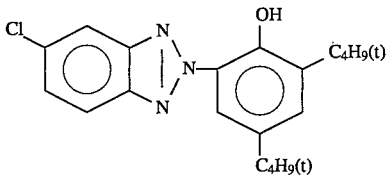

(v)

-continued

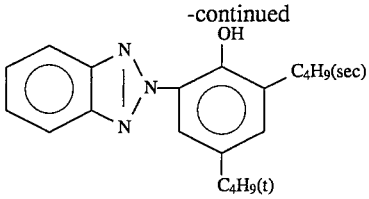

(vi)

(Solv-1) Solvent

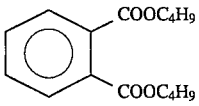

(Solv-2) Solvent

Mixture (1:1 in weight ratio) of

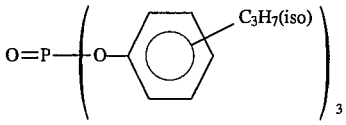

and

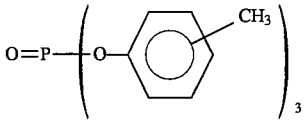

$O{=}P{\leftarrow}O{-}C_9H_{19}(iso))_3$ (Solv-3) Solvent

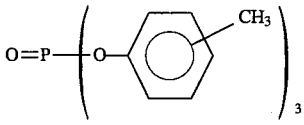

(Solv-4) Solvent (Solv-5) Solvent

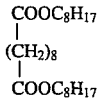

(Solv-6) Solvent

Mixture (80:20 in volume ratio) of

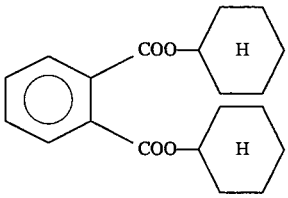

and

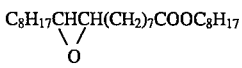

(Solv-7)

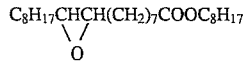

The thus obtained multi-layer color photographic printing paper A was subjected to continuous processing (running test). That is, the color photographic printing paper A was image-wise exposed to light and was continuously processed using an automatic printer FAP3500 (manufactured by Fuji Photo Film Co., Ltd.) in the below described processing steps using solutions having the below described compositions, until the replenishing amount reached twice the volume of the color-developing tank. The composition of color developer was changed as shown in Table 1.

| Processing Step | Temperature (°C.) | Time (sec) | Replenisher (ml/m²) | Tank Volume (liter) |
|---|---|---|---|---|
| Color developing | 38.5 | 45 | 60 | 17 |
| Bleach-fixing | 30–35 | 45 | 60 | 17 |
| Rinse (1) | 30–35 | 20 | — | 8 |
| Rinse (2) | 30–35 | 20 | — | 8 |
| Rinse (3) | 30–35 | 20 | — | 8 |
| Rinse (4) | 30–35 | 30 | 200 | 8 |

Note: Rinsing steps were carried out in 4-tanks countercurrent mode from the tank of rinse (4) to (3) to (2) to (1).

The composition of each processing solution is as followed, respectively:

| Color-developer | Tank Solution | Replenisher |
|---|---|---|
| Water | 800 ml | 800 ml |
| Disodium ethylenediaminetetraacetate | 3 g | 3 g |
| Sodium catechol-3,5-disulfonate | 0.3 g | 0.3 g |
| Triethanolamine | 8.0 g | 8.0 g |
| Potassium bromide | 0.03 g | — |
| Sodium chloride | 6.0 g | — |
| N,N-di(sulfoethyl)hydroxylamine | 5.0 g | 8.0 g |
| Fluorescent whitening agent (WHITEX-4, made by Sumitomo Chemical Ind.) | 1.0 g | 2.0 g |
| Sodium sulfite | (See Table 1) | |
| Additive (See Table 1) | 0.2 g | 0.2 g |
| N-ethyl-N-(β-methanesulfonamidoethyl)-3-methyl-4-aminoaniline sulfate | 5.0 g | 12.0 g |
| Water to make | 1000 ml | 1000 ml |
| pH (25° C.) | 10.05 | 11.15 |

| Bleach-fixing solution (tank solution) | |
|---|---|
| Water | 800 ml |
| Ammonium thiosulfate (50 wt %) | 120 ml |
| Ammonium sulfite | 17 g |
| Iron (III) ammonium ethylenediaminetetraacetate | 60 g |
| Disodium ethylenediaminetetraacetate | 3 g |
| Glacial acetic acid | 7 g |
| Water to make | 1000 ml |
| pH (25° C.) | 5.50 |
| **Bleach-fixing solution (replenisher)** | |
| Water | 500 ml |
| Ammonium thiosulfate (50 wt %) | 220 ml |

-continued

| | |
|---|---|
| Ammonium sulfite | 35 g |
| Iron (III) ammonium ethylenediaminetetraacetate | 110 g |
| Disodium ethylenediaminetetraacetate | 3 g |
| Glacial acetic acid | 25 g |
| Water to make | 1000 ml |
| pH (25° C.) | 4.80 |
| **Rinse solution (Both tank solution and replenisher)** | |
| Ion-exchanged water (calcium and magnesium each are 3 ppm or below) | |

In each running test, at the start of the running and after the completion thereof, each sample was subjected to gradation exposure through a filter for sensitometry by using a sensitometer (manufactured by Fuji Photo Film Co., Ltd.; FWH model; the color temperature of the light source: 3200K) (at that time, the exposure was made such that the exposure amount is 250 CMS for an exposure time of 0.1 sec). The thus exposed sample was developed and the density of the developed sample was measured by an automatic recording densitometer and the change of the maximum optical density Dmax of the yellow (Y), the magenta (M), and the cyan (C) from the start is shown in Table 1.

Each running solution was placed in a 200 ml beaker and was kept at 40° C. and a plate of a vinyl chloride resin having a slit with a depth of 1 mm and a width of 1 mm was rested in the beaker. After two weeks, the height of the crystals deposited in the slit from the solution surface was measured. The level of the solution surface was kept constant by adding water to compensate the evaporated amount every day. Each replenisher solution in a beaker was aged at 5° C. for one week and then the absence or presence of deposited crystals was checked visually.

The amount of deposited crystals was divided into three grades shown .below:

x: large amount (Crystals were found in the all area of beaker bottom or the solution became turbid as a whole.)

Δ: a little amount (Several crystals were found on the bottom of the beaker.)

○: none

For practical use it is required to be ○.

The results are shown in Table 1.

Additives (A), (B), and (C) are the following compounds, which are Exemplified compounds in JP-A Nos. 757/1991 and 240054/1991.

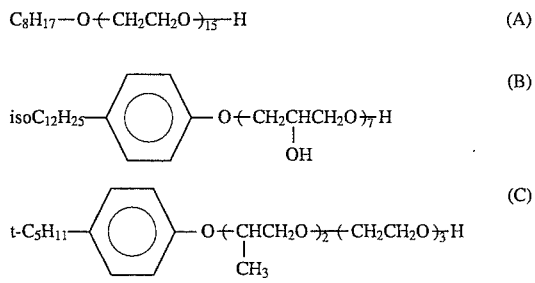

TABLE 1

| Test No. | Concentration of sulfite (M)* Tank solution | Concentration of sulfite (M)* Replenisher | Additive | Change of maximum optical density Y | Change of maximum optical density M | Change of maximum optical density C | Amount of deposit (mm) | Deposit* at low temperature | Remarks |
|---|---|---|---|---|---|---|---|---|---|
| 1 | 0.004 | 0.006 | — | −0.18 | −0.24 | −0.28 | 7 | Δ | Comparison |
| 2 | 0.004 | 0.006 | A | −0.14 | −0.20 | −0.24 | 4 | x | Comparison |
| 3 | 0.004 | 0.006 | B | −0.15 | −0.21 | −0.24 | 4 | x | Comparison |
| 4 | 0.004 | 0.006 | C | −0.16 | −0.22 | −0.27 | 4 | x | Comparison |
| 5 | 0.004 | 0.006 | I-1 | −0.06 | −0.09 | −0.08 | 2 | ○ | Invention |
| 6 | 0.004 | 0.006 | I-7 | −0.07 | −0.09 | −0.08 | 2 | ○ | Invention |
| 7 | 0.004 | 0.006 | I-13 | −0.08 | −0.10 | −0.09 | 2 | ○ | Invention |
| 8 | — | — | — | −0.12 | −0.19 | −0.18 | 21 | Δ | Comparison |
| 9 | 0.002 | 0.003 | — | −0.15 | −0.21 | −0.23 | 19 | Δ | Comparison |
| 10 | 0.002 | 0.003 | A | −0.14 | −0.20 | −0.22 | 7 | x | Comparison |
| 11 | 0.002 | 0.003 | C | −0.15 | −0.21 | −0.22 | 6 | x | Comparison |
| 12 | 0.002 | 0.003 | I-1 | −0.02 | −0.02 | −0.02 | 2 | ○ | Invention |
| 13 | 0.002 | 0.003 | I-7 | −0.02 | −0.02 | −0.02 | 2 | ○ | Invention |
| 14 | 0.002 | 0.003 | I-13 | −0.03 | −0.03 | −0.03 | 2 | ○ | Invention |
| 15 | — | — | A | −0.12 | −0.17 | −0.18 | 10 | x | Comparison |
| 16 | — | — | B | −0.11 | −0.16 | −0.17 | 9 | x | Comparison |
| 17 | — | — | C | −0.11 | −0.16 | −0.17 | 10 | x | Comparison |
| 18 | — | — | I-1 | 0 | −0.01 | −0.01 | 0 | ○ | Invention |
| 19 | — | — | I-7 | 0 | −0.01 | −0.02 | 0 | ○ | Invention |
| 20 | — | — | I-13 | 0 | −0.01 | −0.02 | 0 | ○ | Invention |

Note:
*M: mol/liter
**Amount of deposit of crystal
x: large amount
Δ: a little amount
○: none As is apparent from the results in Table 1, according to the present invention, the change of the maximum optical density, the separation of crystals, and the deposit of crystals at low temperatures are made good (Test Nos. 5 to 7, 12 to 14, and 18 to 20) and the effect is particularly remarkable in the case wherein any sulfite is not contained (Test Nos. 18 to 20).

EXAMPLE 2

Multi-layer Color Photographic Printing Papers B, C., and D were prepared in the same manner as Multilayer Color Photographic Printing Paper A of Example 1, except that the silver chloride content of the emulsion composition in each layer was changed as shown in Table 2.

TABLE 2

| Sample | A | B | C | D |
|---|---|---|---|---|
| First layer | 99.7 | 95.9 | 90.9 | 86.1 |
| Third layer | 99.2 | 95.8 | 90.7 | 86.0 |
| Fifth layer | 99.4 | 95.7 | 90.5 | 86.2 |

Note; Each figure is shown in mol %.

The thus obtained Multi-layer Color Photographic Printing Papers A, B, C., and D were subjected to a running test in the same manner as for Test Nos. 1, 5, 8, and 18 in Example 1 and, similarly to Example 1, the change of the maximum optical density and the amount of a deposit in the slit were evaluated. The results are summarized in Table 3.

TABLE 3

| Test No. | Sample: Color photographic printing paper | Sample: Color developer No. | Change of maximum optical density Y | Change of maximum optical density M | Change of maximum optical density C | Amount of deposit (mm) | Remarks |
|---|---|---|---|---|---|---|---|
| 1 | A | 1 | −0.18 | −0.24 | −0.28 | 6 | Comparison |
| 2 | A | 5 | −0.05 | −0.04 | −0.04 | 3 | Invention |
| 3 | A | 8 | −0.12 | −0.19 | −0.18 | 19 | Comparison |
| 4 | A | 18 | 0 | 0 | −0.01 | 0 | Invention |
| 5 | B | 1 | −0.17 | −0.25 | −0.29 | 5 | Comparison |
| 6 | B | 5 | −0.06 | −0.06 | −0.06 | 3 | Invention |
| 7 | B | 8 | −0.13 | −0.19 | −0.19 | 18 | Comparison |

TABLE 3-continued

| Test No. | Sample: Color photographic printing paper | Sample: Color developer No. | Change of maximum optical density: Y | M | C | Amount of deposit (mm) | Remarks |
|---|---|---|---|---|---|---|---|
| 8 | B | 18 | −0.03 | −0.04 | −0.05 | 2 | Invention |
| 9 | C | 1 | −0.17 | −0.21 | −0.25 | 7 | Comparison |
| 10 | C | 5 | −0.07 | −0.08 | −0.08 | 4 | Invention |
| 11 | C | 8 | −0.10 | −0.15 | −0.18 | 19 | Comparison |
| 12 | C | 18 | −0.04 | −0.06 | −0.06 | 2 | Invention |
| 13 | D | 1 | −0.18 | −0.24 | −0.28 | 5 | Comparison |
| 14 | D | 5 | −0.07 | −0.09 | −0.09 | 3 | Invention |
| 15 | D | 8 | −0.13 | −0.19 | −0.22 | 22 | Comparison |
| 16 | D | 18 | −0.05 | −0.07 | −0.07 | 3 | Invention |

As is apparent from the results in Table 3, according to the present invention, the change of the maximum optical density and the deposit of crystals are made good (Test Nos. 2, 4, 8, 10, 12, 14 and 16). In the test No. 4 wherein the concentration of chloride in color photographic printing paper (A) is more than 98 mol % and the color developer (18) does not contain sulfite ions at all, the effect is particularly remarkable.

EXAMPLE 3

After the surface of a paper support, whose both surfaces were laminated with polyethylene, was subjected to corona discharge treatment, a gelatin undercoat layer containing sodium dodecylbenzenesulfonate was provided thereon, and various photographic constitutional layers were applied, to prepare a multi-layer color photographic printing paper (301) having the below-given layer composition. The coating solution were prepared as follows:

Preparation of the First Layer Coating Solution 153.0 Grams of yellow coupler (ExY), 15.0 g of image-dye stabilizer (Cpd-1), 7.5 g of image-dye stabilizer (Cpd-2), and 16.0 g of image-dye stabilizer (Cpd-3) were dissolved in 25 g of solvent (Solv-1), 25 g of solvent (Solv-2) and 180 ml of ethyl acetate, and the solution was added into 1,000 g of 10% aqueous gelatin solution containing 60 ml of 10% sodium dodecylbenzene-sulfonate and 10 g of citric acid, and emulsified and dispersed, to prepare an emulsified dispersion A. Separately, a silver chlorobromide emulsion A (comprising cubic silver halide grains made up of a mixture of a large size emulsion A having an average grain size of 0.88 μm and a small size emulsion A having an average grain size of 0.70 μm in a molar ratio of 3:7 in terms of silver, wherein the deviation coefficients of the grain size distributions are 0.08 and 0.10, respectively; each of the emulsions has 0.3 mol % of silver bromide being localized on the surface of the grains; and the remaining part of grain is made of silver chloride) was prepared. In this emulsion, blue-sensitive sensitizing dyes A and B, shown below, respectively were added in such amounts of $2.0\times10^{-4}$ mol to the large size emulsion A and $2.5\times10^{-4}$ mol to the small size emulsion A, per mol of silver. The chemical ripening of this emulsion was carried out by adding a sulfur sensitizing agent and a gold sensitizing agent. The above-described emulsified dispersion A and this silver chlorobromide emulsion A were mixed together and dissolved to give the composition shown below, thereby preparing the first layer coating solution.

Coating solutions for the second to seventh layers were prepared in the same manner as the first layer coating solution. As the gelatin hardener of each layer, 1-oxy-3,5-dichloro-s-triazine sodium salt was used.

Further, Cpd-14 and Cpd-15, shown below, were added to each layer so that the total amounts thereof might be 25.0 mg/m$^2$ and 50.0 mg/m$^2$, respectively.

In the silver chlorobromide emulsions of photosensitive emulsion layers, the following spectral sensitizing dyes were used.

Blue-sensitive emulsion layer:

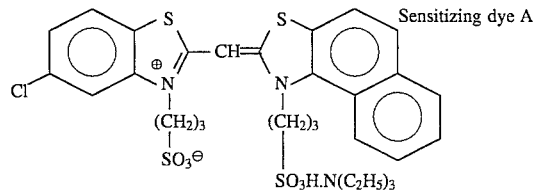

and

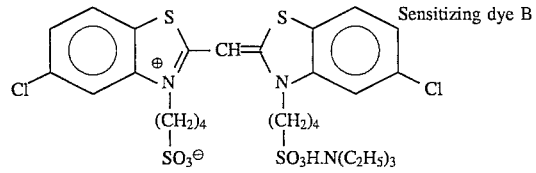

(each $2.0\times10^{-4}$ mol to the large size emulsion and $2.5\times10^{-4}$ mol to the small size emulsion, per mol of silver halide. )

Green-sensitive emulsion layer:

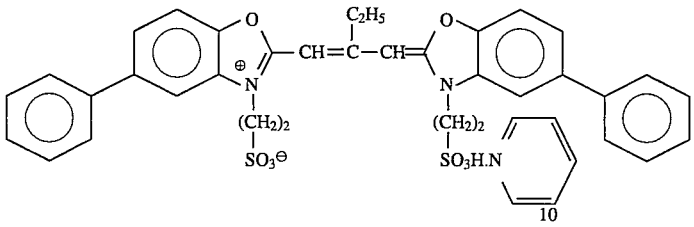

Sensitizing dye C ($4.0\times10^{-4}$ mol to the large size emulsion and $5.6\times10^{-4}$ mol to the small size emulsion, per mol of silver halide )
and

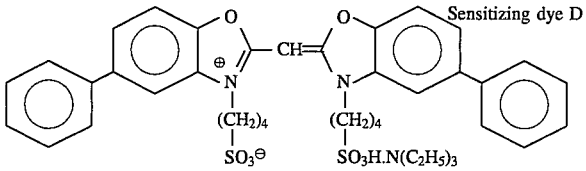

Sensitizing dye D ($7.0\times10^{-5}$ mol to the large size emulsion and $1.0\times10^{-5}$ mol to the small size emulsion, per mol of silver halide )
Red-sensitive emulsion layer:

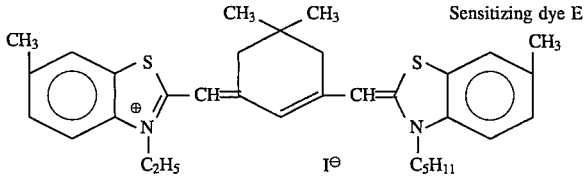

Sensitizing dye E ($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

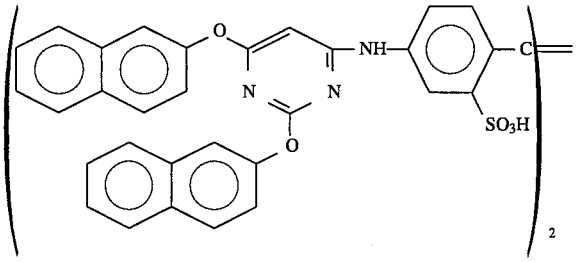

Further, respectively to the blue-sensitive emulsion layer, the green-sensitive emulsion layer, and the red-sensitive emulsion layer, was added 1-(5-methylureidophenyl)-5-mercaptotetrazole in respective amounts of $8.5\times10^{-5}$ mol, $7.7\times10^{-4}$ mol, and $2.5\times10^{-4}$ mol, per mol of the silver halide.

Further, respectively to the blue-sensitive emulsion layer and the green-sensitive emulsion layer, was added 4-hydroxy-6-methyl-1,3,3a,7-tetrazaindene in respective amounts of $1\times10^{-4}$ mol and $2\times10^{-4}$ mol, per mol of the silver halide.

Further, to prevent irradiation, the following dye (the coating amount is indicated in parentheses) was added to the emulsion layers.

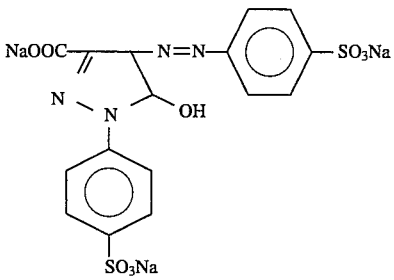

(10 mg/m²)

-continued

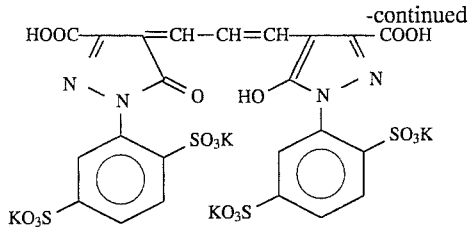

(10 mg/m²)

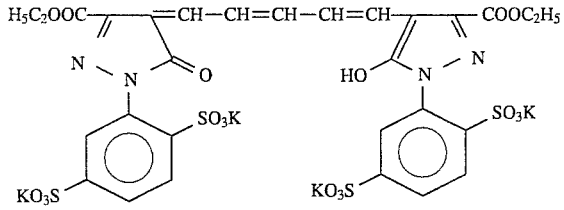

(40 mg/m²)

and

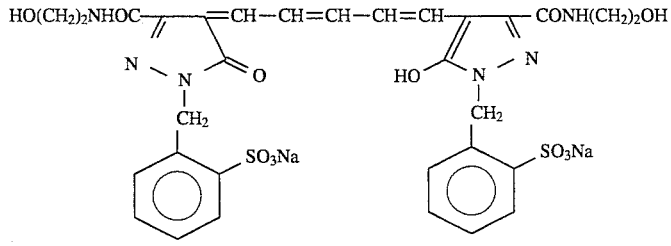

(20 mg/m²)

(Layer Composition)

The layer compositions of the layers are shown below. The numerals indicate coating amounts (g/m²). The coating amount of each of the silver halide emulsions is in terms of silver.

Support

Paper laminated on both sides with polyethylene (a white pigment, $TiO_2$, and a bluish dye, ultra-marine, were included in the first layer side of the polyethylene-laminated film)

| | |
|---|---|
| First Layer (Blue-sensitive emulsion layer) | |
| The above-described silver chlorobromide emulsion A | 0.27 |
| Gelatin | 1.36 |
| Yellow coupler (ExY) | 0.79 |
| Image-dye stabilizer (Cpd-1) | 0.08 |
| Image-dye stabilizer (Cpd-2) | 0.04 |
| Image-dye stabilizer (Cpd-3) | 0.08 |
| Solvent (Solv-1) | 0.13 |
| Solvent (Solv-2) | 0.13 |
| Second Layer (Color-mix preventing layer) | |
| Gelatin | 1.00 |
| Color mix inhibitor (Cpd-4) | 0.06 |
| Solvent (Solv-7) | 0.03 |
| Solvent (Solv-2) | 0.25 |
| Solvent (Solv-3) | 0.25 |
| Third Layer (Green-sensitive emulsion layer) | |
| Silver chlorobromide emulsion (comprising cubic silver halide grains made up of a mixture of a large size emulsion B having an average grain size of 0.55 μm and a small size emulsion B having an average grain size of 0.39 μm in a molar ratio of 1:3 in terms of silver, wherein the deviation coefficients of the grain size distributions are 0.10 and 0.08 respectively; each of the emulsions has 0.8 mol % of AgBr being localized on the surface of the grains; and the remaining part of grain is AgCl) | 0.13 |

-continued

| | |
|---|---|
| Gelatin | 1.45 |
| Magenta coupler (ExM) | 0.16 |
| Image-dye stabilizer (Cpd-5) | 0.15 |
| Image-dye stabilizer (Cpd-2) | 0.03 |
| Image-dye stabilizer (Cpd-6) | 0.01 |
| Image-dye stabilizer (Cpd-7) | 0.01 |
| Image-dye stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Color-mix preventing layer) | |
| Gelatin | 0.70 |
| Color-mix inhibitor (Cpd-4) | 0.04 |
| Solvent (Solv-7) | 0.02 |
| Solvent (Solv-2) | 0.18 |
| Solvent (Solv-3) | 0.18 |
| Fifth Layer (Red-sensitive emulsion layer) | |
| Silver chlorobromide emulsion (comprising cubic silver halide grains made up of a mixture of a large size emulsion C having an average grain size of 0.50 μm and a small size emulsion C having an average grain size of 0.41 μm in a molar ratio of 1:4 in terms of silver, wherein the deviation coefficients of the grain size distributions are 0.09 and 0.11 respectively; each of the emulsions has 0.8 mol % of AgBr being localized on the surface of the grains; and the remaining part of grain is AgCl) | 0.20 |
| Gelatin | 0.85 |
| Cyan coupler (ExC) | 0.33 |
| Ultraviolet-absorbing agent (UV-2) | 0.18 |
| Image-dye stabilizer (Cpd-9) | 0.15 |
| Image-dye stabilizer (Cpd-10) | 0.15 |
| Image-dye stabilizer (Cpd-11) | 0.01 |
| Solvent (Solv-6) | 0.22 |
| Image-dye stabilizer (Cpd-8) | 0.01 |
| Image-dye stabilizer (Cpd-6) | 0.01 |
| Solvent (Solv-1) | 0.01 |
| Image-dye stabilizer (Cpd-1) | 0.33 |
| Sixth layer (Ultraviolet-absorbing layer) | |

-continued

| | |
|---|---|
| Gelatin | 0.55 |
| Ultraviolet-absorbing agent (UV-1) | 0.38 |
| Image-dye stabilizer (Cpd-12) | 0.15 |
| Image-dye stabilizer (Cpd-5) | 0.02 |
| Seventh layer (Protective layer) | |
| Gelatin | 1.13 |
| Acryl-modified copolymer of polyvinyl alcohol (modification degree: 17%) | 0.05 |
| Liquid paraffin | 0.02 |
| Image-dye stabilizer (Cpd-13) | 0.01 |

Compounds used are as follows:

(ExY) Yellow coupler

Mixture (1:1 in molar ratio) of (a) and (b)

(a)

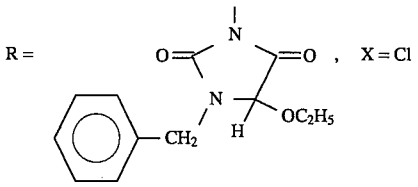

(b)

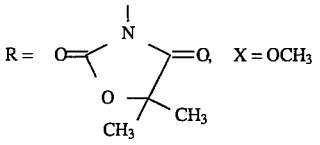

of

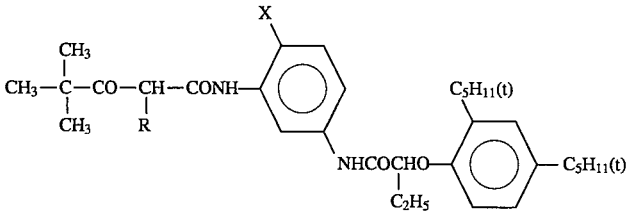

(ExM) Magenta coupler

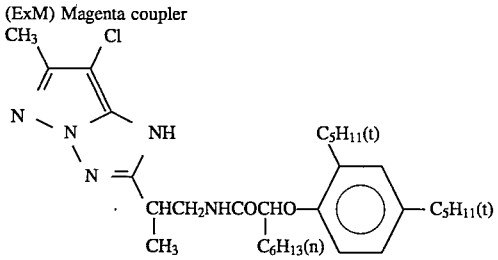

(ExC) Cyan coupler

Mixture (3:7 in molar ratio) of

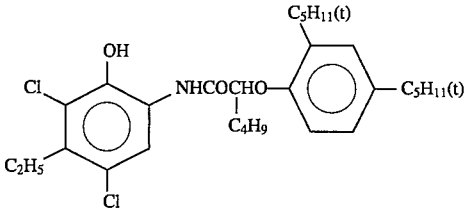

-continued and

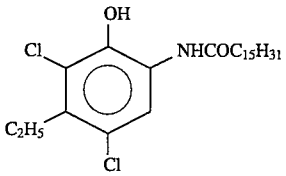

(Cpd-1) Image-dye stabilizer

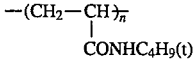

Average molecular weight: 60,000

(Cpd-2) Image-dye stabilizer

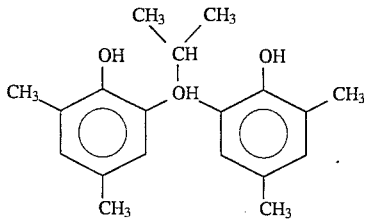

(Cpd-3) Image-dye stabilizer

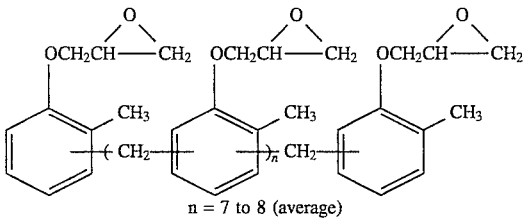

n = 7 to 8 (average)

(Cpd-4) Color-mix inhibitor (Cpd-5) Image-dye stabilizer

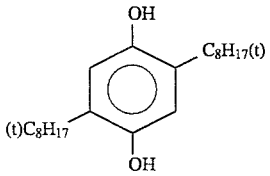

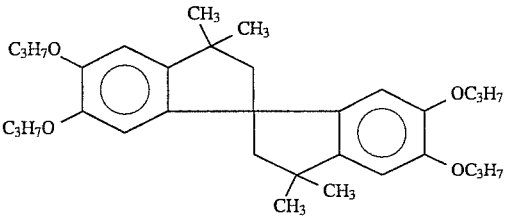

(Cpd-6) Image-dye stabilizer (Cpd-7) Image-dye stabilizer

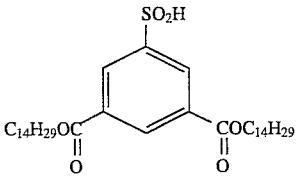

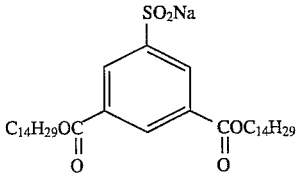

(Cpd-8) Image-dye stabilizer (Cpd-9) Image-dye stabilizer

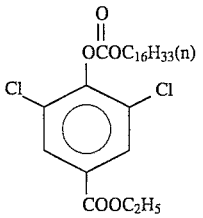

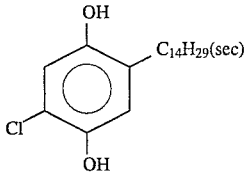

(Cpd-10) Image-dye stabilizer (Cpd-11) Image-dye stabilizer

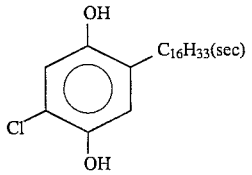

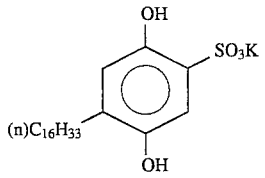

(Cpd-12) Image-dye stabilizer

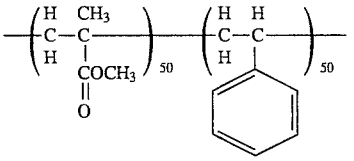

Average molecular weight: 60,000

(Cpd-13) Image-dye stabilizer

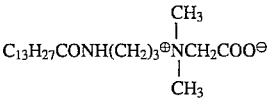

(Cpd-14) Antiseptic (Cpd-15) Antiseptic

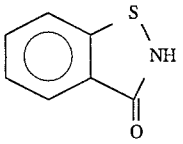

(Cpd-14) Antiseptic

-continued (Cpd-15) Antiseptic

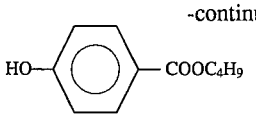

(UV-1) Ultraviolet-absorbing agent

Mixture ((i):(ii):(iii):(iv)=10:5:1:5 in weight ratio) of (i)

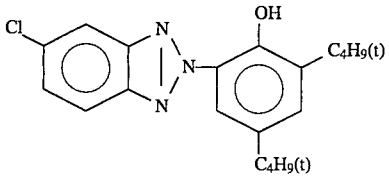

(ii)

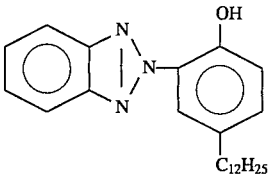

(iii)

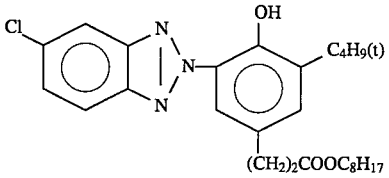

(iv)

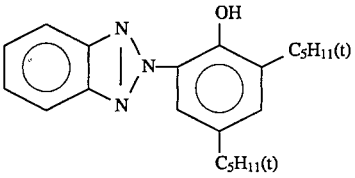

(UV-2) Ultraviolet-absorbing agent

Mixture of ((v):(vi):(vii)=1:2:2 in weight ratio) of (v)

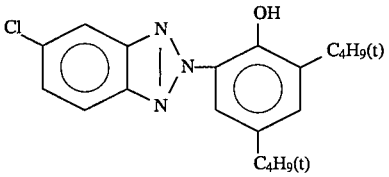

(vi)

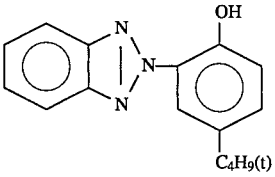

(vii)

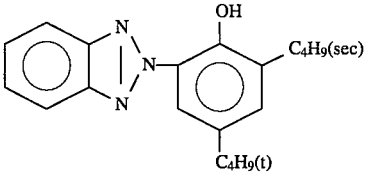

(Solv-1) Solvent

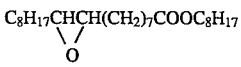

-continued (Solv-2) Solvent

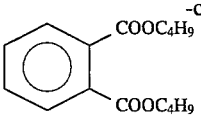

(Solv-3) Solvent

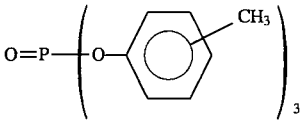

(Solv-4) Solvent

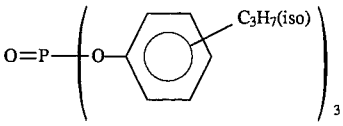

(Solv-5) Solvent

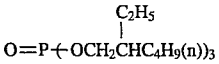

(Solv-6) Solvent

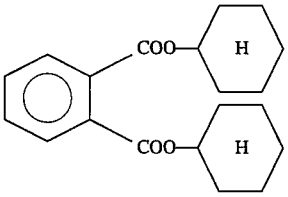

(Solv-7) Solvent

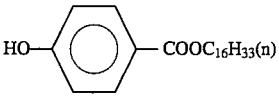

The thus obtained multi-layer color photographic printing paper 301 was image-wise exposed to light and was continuously processed (running test) in the below described processing steps using solutions having the below described compositions, until the replenishing amount reached twice the volume of the color-developing tank, in the same manner as Example 1, except that the composition of developer was changed as shown in Table 4.

| Processing Step | Temperature (°C.) | Time (sec) | Replenisher (ml/m²) | Tank Volume (liter) |
|---|---|---|---|---|
| Color developing | 38 | 30 | 100 | 10 |
| Bleach-fixing | 30–35 | 30 | 60 | 10 |
| Rinse (1) | 30–35 | 20 | — | 7 |
| Rinse (2) | 30–35 | 20 | — | 7 |
| Rinse (3) | 30–35 | 20 | 200 | 7 |

Note: Rinsing steps were carried out in 3-tanks countercurrent mode from the tank of rinse (3) → (2) → (1).

The composition of each processing solution is as followed, respectively:

| Color-developer | Tank Solution | Replenisher |
|---|---|---|
| Water | 800 ml | 800 ml |
| Diethylenetriaminepentaacetic acid | 3 g | 3 g |
| Sodium catechol-3,5-disulfonate | 0.3 g | 0.3 g |
| Triethanolamine | 8.0 g | 8.0 g |
| Potassium bromide | 0.02 g | — |
| Sodium chloride | 4.0 g | — |
| N,N-diethylhydroxylamine | 5.0 g | 7.0 g |
| Fluorescent whitening agent (UVITEX CK, made by Ciba Geigy) | 1.0 g | 1.5 g |
| Sodium sulfite | 0.1 g | 0.1 g |

-continued

| | | |
|---|---|---|
| Additive (See Table 4) | 0.1 g | 0.1 g |
| N-ethyl-N-(β-methanesulfonamidoethyl)-3-methyl-4-aminoaniline sulfate | 5.0 g | 10.0 g |
| Water to make | 1000 ml | 1000 ml |
| pH (25° C.) | 10.05 | 11.00 |

| Bleach-fixing solution (tank solution) | |
|---|---|
| Water | 800 ml |
| Ammonium thiosulfate (50 wt %) | 120 ml |
| Ammonium sulfite | 17 g |
| Iron (III) ammonium ethylenediaminetetraacetate | 60 g |
| Disodium ethylenediaminetetraacetate | 3 g |
| Glacial acetic acid | 7 g |
| Water to make | 1000 ml |
| pH (25° C.) | 5.50 |
| **Bleach-fixing solution (replenisher)** | |
| Water | 500 ml |
| Ammonium thiosulfate (50 wt %) | 240 ml |
| Ammonium sulfite | 35 g |
| Iron (III) ammonium ethylenediaminetetraacetate | 130 g |
| Disodium ethylenediaminetetraacetate | 3 g |
| Glacial acetic acid | 25 g |
| Water to make | 1000 ml |
| pH (25° C.) | 4.80 |
| **Rinse solution (Both tank solution and replenisher)** | |
| Ion-exchanged water (calcium and magnesium each are 3 ppm or below) | |

In each running test, the change of maximum optical density was determined and the deposit of crystal at a low temperature was evaluated, in the same manner as in Example 1. Results are shown in Table 4.

TABLE 4

| Test No. | Additive | Change of maximum optical density Y | M | C | Deposit at low temperature** | Remarks |
|---|---|---|---|---|---|---|
| 301 | — | −0.24 | −0.28 | −0.23 | Δ | Comparison |
| 302 | A* | −0.14 | −0.20 | −0.22 | x | Comparison |
| 303 | B* | −0.14 | −0.21 | −0.23 | x | Comparison |
| 304 | C* | −0.15 | −0.22 | −0.23 | x | Comparison |
| 305 | I-2 | −0.04 | −0.04 | −0.05 | ○ | Invention |
| 306 | I-4 | −0.04 | −0.03 | −0.04 | ○ | Invention |
| 307 | I-8 | −0.02 | −0.02 | −0.03 | ○ | Invention |
| 308 | I-11 | −0.05 | −0.02 | −0.03 | ○ | Invention |
| 309 | I-18 | −0.04 | −0.04 | −0.05 | ○ | Invention |
| 310 | I-19 | −0.03 | −0.04 | −0.03 | ○ | Invention |
| 311 | I-20 | −0.03 | −0.03 | −0.05 | ○ | Invention |
| 312 | I-21 | −0.04 | −0.04 | −0.05 | ○ | Invention |
| 313 | I-22 | −0.04 | −0.04 | −0.05 | ○ | Invention |
| 314 | I-23 | −0.03 | −0.04 | −0.06 | ○ | Invention |

Note;
*Additives A, B, and C are same as in Example 1.
**Deposit of crystal at low temperature?
x: large amount
Δ: a little amount
○: none As is apparent from the results in Table 4, according to the present invention, the change of the maximum optical density at running processing and the deposit of crystals at low temperature are made good.

Having described our invention as related to the present embodiments, it is our intention that the invention not be limited by any of the details of the description, unless otherwise specified, but rather be construed broadly within its spirit and scope as set out in the accompanying claims.

What we claim is:

1. A color developer for processing a silver halide color photographic material, which comprises 0.01–10 g/l of a water-soluble silicone compound and 0.5–10 g/l of an aromatic primary amine color developing agent, said color developer being substantially free of sulfite ions such that the concentration of sulfite ions is $3.0\times10^{-3}$ mol or less per liter of said color developer.

2. The color developer as claimed in claim 1, wherein said water-soluble silicone compound is at least one water-soluble silicone compound represented by the following formula (I):

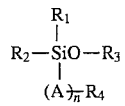

wherein $R_1$, $R_2$, $R_3$, and $R_4$, which may be the same or different, each represent a substituent or a linking group; at least one of $R_1$, $R_2$, $R_3$, and $R_4$ represents a water-soluble group; A represents a bivalent group; and n is an integer of 0 to 10.

3. The color developer as claimed in claim 1, wherein said water-soluble silicone compound dissolves in an amount of 5 mg to 100 g per liter of water at a temperature of 20° C. and at a pH of 10.

4. The color developer as claimed in claim 1, wherein said water-soluble silicone compound has a surface-active property that lower surface tension of water.

5. The color developer as claimed in claim 2, wherein the water-soluble group which is represented by at least one of $R_1$, $R_2$, $R_3$, and $R_4$ is selected from the group consisting of $-(CH_2CH_2O)_a-H$, $-(CH(CH_3)CH_2O)_b-H$, $-(CH_2CH_2CH_2O)_c-H$, $-COOM$, $-SO_3M$, $-OSO_3M$, $-PO_3M_2$, and $-OH$, wherein a, b, and c are each an integer of 3 to 100, and M represents a hydrogen atom, an alkali-metal salt, or an ammonium salt.

6. The color developer as claimed in claim 2, wherein said water-soluble silicone compound represented by formula (I) has 2 or more of siloxane units shown by the following formula:

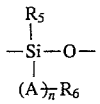

wherein $R_5$ and $R_6$ have the same meanings as $R_1$, $R_2$, $R_3$, and $R_4$ in formula (I), provided that at least one of $R_5$ and $R_6$ represents a water-soluble group which is defined for $R_1$, $R_2$, $R_3$, and $R_4$, and A and n have the same meanings as A and n in formula (I).

7. The color developer as claimed in claim 2, wherein $R_1$, $R_2$, $R_3$ and $R_4$, which may be the same or different, each represent a hydrogen atom, a halogen atom, an alkyl group, an aryl group or an alkoxy group.

8. The color developer as claimed in claim 2, wherein A represents a methylene group, an ethylene group, a propylene group, or an oxo group.

9. A color developer for processing a silver halide color photographic material, which comprises 0.03–3 g/l of a water-soluble silicone compound and 0.1–20 g/l of an aromatic primary amine color developing agent, said color developer being substantially free of sulfite ions wherein the concentration of sulfite ions is $3.0\times10^{-3}$ mol or less per liter of said color developer.

10. The color developer as claimed in claim 9, wherein said water-soluble silicone compound is at least one water-soluble silicone compound represented by the following formula (I): formula (I):

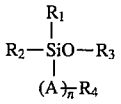

wherein $R_1$, $R_2$, $R_3$, and $R_4$, which may be the same or different, each represent a substituent or a linking group; at least one of $R_1$, $R_2$, $R_3$, and $R_4$ represents a water-soluble group; A represents a divalent group; and n is an integer of 0 to 10.

11. The color developer as claimed in claim 9, wherein said water-soluble silicone compound dissolves in an amount of 5 mg to 100 g per liter of water at a temperature of 20° C. and at a pH of 10.

12. The color developer as claimed in claim 9, wherein said water-soluble silicone compound has a surface-active property that lower surface tension of water.

13. The color developer as claimed in claim 10, wherein the water-soluble group which is represented by at least one of $R_1$, $R_2$, $R_3$, and $R_4$ is selected from the group consisting of $-(CH_2CH_2O)_a-H$, $-(CH(CH_3)CH_2O)_b-H$, $-(CH_2CH_2CH_2O)_c-H$, $-COOM$, $-SO_3M$, $-OSO_3M$, $-PO_3M_2$, and $-OH$, wherein a, b, and c are each an integer of 3 to 100, and M represents a hydrogen atom, an alkali metal salt, or an ammonium salt.

14. The color developer as claimed in claim 10, wherein said water-soluble silicone compound represented by formula (I) has 2 or more of siloxane units shown by the following formula:

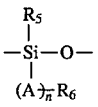

wherein $R_5$ and $R_6$ have the same meanings as $R_1$, $R_2$, $R_3$, and $R_4$ in formula (I), provided that at least one of $R_5$ and $R_6$ represents a water-soluble group which is defined for $R_1$, $R_2$, $R_3$, and $R_4$, and A and n have the same meanings as A and n in formula (I) .

15. The color developer as claimed in claim 10, wherein $R_1$, $R_2$, $R_3$ and $R_4$, which may be the same or different, each represent a hydrogen atom, a halogen atom, an alkyl group, an aryl group or an alkoxy group.

16. The color developer as claimed in claim 10, wherein A represents a methylene group, an ethylene group, a propylene group, or an oxo group.

* * * * *